US006517198B2

(12) United States Patent
Yoshihira et al.

(10) Patent No.: US 6,517,198 B2
(45) Date of Patent: Feb. 11, 2003

(54) LIQUID EJECTING HEAD, HEAD CARTRIDGE, AND LIQUID EJECTING AND RECORDING APPARATUS

(75) Inventors: Aya Yoshihira, Kanagawa (JP); Isao Kimura, Kanagawa (JP); Kiyomitsu Kudo, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/729,281

(22) Filed: Dec. 5, 2000

(65) Prior Publication Data

US 2001/0003460 A1 Jun. 14, 2001

(30) Foreign Application Priority Data

Dec. 10, 1999 (JP) ..... 11-351551

(51) Int. Cl.[7] ..... B41J 2/175
(52) U.S. Cl. ..... 347/87
(58) Field of Search ..... 347/85, 86, 87, 347/65, 72, 30, 68, 20

(56) References Cited

U.S. PATENT DOCUMENTS

| | | | | |
|---|---|---|---|---|
| 3,379,803 A | | 4/1968 | Tittmann et al. | 264/81 |
| 4,723,129 A | | 2/1988 | Endo et al. | 347/56 |
| 5,479,197 A | | 12/1995 | Fujikawa et al. | 347/63 |
| 5,625,393 A | * | 4/1997 | Asai | 347/69 |
| 5,943,074 A | | 8/1999 | Kashino et al. | 347/54 |
| 6,062,680 A | | 5/2000 | Yoshihira et al. | 347/65 |
| 6,074,543 A | | 6/2000 | Yoshihira et al. | 205/75 |
| 6,102,529 A | | 8/2000 | Okazaki et al. | 347/65 |
| 6,109,735 A | | 8/2000 | Kashino et al. | 347/65 |
| 6,154,237 A | | 11/2000 | Kashino et al. | 347/48 |
| 6,164,763 A | | 12/2000 | Sugama et al. | 347/63 |
| 6,182,264 B1 | | 1/2001 | Yoshihira et al. | 347/65 |
| 6,206,505 B1 | * | 3/2001 | Yoshihira et al. | 347/48 |
| 6,260,953 B1 | * | 7/2001 | Silverbrook et al. | 347/54 |
| 6,305,789 B1 | * | 10/2001 | Nakata et al. | 347/61 |
| 6,312,111 B1 | * | 11/2001 | Kimura et al. | 347/65 |
| 6,341,850 B1 | * | 1/2002 | Sakai | 347/70 |

FOREIGN PATENT DOCUMENTS

| | | |
|---|---|---|
| EP | 518 380 | * 12/1992 |
| JP | 55-81172 | 6/1980 |
| JP | 59-26270 | 2/1984 |
| JP | 61-59911 | 3/1986 |
| JP | 61-59914 | 3/1986 |
| JP | 4-329148 | 11/1992 |
| JP | 5-229122 | 9/1993 |
| JP | 6-191061 | * 7/1994 |

* cited by examiner

*Primary Examiner*—Michael Nghiem
(74) *Attorney, Agent, or Firm*—Fitzpatrick, Cella, Harper & Scinto

(57) ABSTRACT

In a liquid ejecting head having a first liquid flow path communicating with an ejecting port for ejecting a liquid to be ejected and an element substrate having a heating element for forming a bubble from a bubble forming liquid as well as including a second liquid flow path corresponding to the first liquid flow path and a movable separation membrane for substantially separating the first liquid flow path and the second liquid flow path corresponding to the first liquid flow path from each other at all times, the liquid ejecting head includes an atmosphere communication port facing the atmosphere for communicating the second liquid flow path with the atmosphere, and an atmosphere communication path having an atmosphere communication path introduction port facing the second liquid flow path, wherein the atmosphere communication port is formed through the same surface as that of the ejecting port, whereby the liquid ejecting head can remove remaining bubbles in the bubble forming liquid by a simple arrangement as well as improve a liquid ejecting efficiency by effectively transmitting the pressure of a bubble formed in the bubble forming liquid to the liquid to be ejected.

30 Claims, 11 Drawing Sheets

LIQUID EJECTING HEAD, HEAD CARTRIDGE, AND LIQUID EJECTING AND RECORDING APPARATUS

BACKGROUND OF THE INVENTION

1. Field of the Invention

The present invention relates to a liquid ejecting head, a head cartridge, and a liquid ejecting apparatus.

2. Description of the Related Art

Heretofore, there is known an inkjet recording method, that is, a so-called bubble jet recording method by which a state of ink is changed together with a rapid change of its volume (generation of bubbles) by applying energy such as heat and the like thereto, by which the ink is ejected from an ejecting port by operating force based on the change of the state, and by which the ink is deposited on a recording medium so as to form an image thereon. As shown in Japanese Patent Publication Nos. 61-59911 and 61-59914, a recording apparatus using the bubble jet recording method ordinarily includes an ejecting port for ejecting ink, an ink flow path communicating with the ejecting port, a heating element (electro-thermal transducer) as an energy generation means for ejecting ink in the ink flow path.

The above recording method has such many excellent features that an image of high quality can be recorded at high speed with low noise as well as an image recorded by a small apparatus with high resolution and further a color image can be easily obtained because ejecting ports for ejecting ink can be very densely disposed in a head used in the method. Accordingly, the bubble jet recording method is recently utilized in many office equipment such as a printer, copy machine, facsimile and the like and further in an industrial system such as a textile printer and the like.

On the other hand, in the conventional bubble jet recording method, ink may be burned and deposited on the surface of a heating element because it generates heat repeatedly while in contact the ink. Further, when a liquid to be ejected is liable to be deteriorated by heat or when a bubble cannot be sufficiently obtained therefrom, the liquid may not be excellently ejected when it is directly heated by the above-mentioned heating element to form a bubble.

In contrast, the applicant proposes, in Japanese Patent Laid-Open No. 55-81172, a method of ejecting a liquid by forming a bubble from a bubble forming liquid by thermal energy through a flexible membrane which separates the bubble forming liquid from the liquid to be ejected. The flexible membrane and the bubble forming liquid in the method is arranged such that the flexible membrane is disposed at a portion of nozzles. In contrast to the above arrangement, an arrangement in which a large membrane for separating an overall head vertically is disclosed in Japanese Patent Laid-Open No. 59-26270. The large membrane is held by two sheet members for forming two liquid paths for the purpose of preventing liquids in the two liquid paths from being mixed with each other.

On the other hand, Japanese Patent Laid-Open No. 5-229122 discloses an arrangement using a bubble forming liquid having a boiling point lower than that of a liquid to be ejected and Japanese Patent Laid-Open No. 4-329148 discloses an arrangement using a conductive liquid as a bubble forming liquid as arrangements in which bubble forming liquids having features are used and bubble forming characteristics are taken into consideration.

In the heads as described above for completely separating the liquid to be ejected from the bubble forming liquid, it is an important problem to stabilize the state of the bubble forming liquid at all times to perform injection stably.

However, there is a possibility that fine bubbles remain in the bubble forming liquid after bubbles are formed depending upon driving conditions because the bubble forming liquid is not ejected and that the fine bubbles obstruct stable formation of bubbles.

To remove the remaining bubbles, while there are a method of previously deaerate the bubble forming liquid, and the like, the most effective method is to provide a head with a structure capable of removing remaining bubbles.

Thus, the inventors have devised a liquid ejecting head having a structure for ciculating a bubble forming liquid to remove remaining bubbles.

However, in the above head, it is necessary to provide a collection path for circulating the bubble forming liquid, which not only makes the structure of the head complex but also it is necessary to draw or pressurize the bubble forming liquid to circulate it. Accordingly, there is problem that a load applied to the liquid ejecting head and apparatus is increased.

SUMMARY OF THE INVENTION

An object of the present invention is to provide a liquid ejecting head, a head cartridge, and a liquid ejecting apparatus capable of removing remaining bubbles in a bubble forming liquid by a simple arrangement as well as of improving an ejecting efficiency by effectively transmitting the pressure of a bubble to a liquid to be ejected.

To achieve the above object, in a liquid ejecting head of the present invention having a first liquid flow path communicating with an ejecting port for ejecting a liquid to be ejected and an element substrate having a heating element for forming a bubble from a bubble forming liquid as well as including a second liquid flow path corresponding to the first liquid flow path and a movable separation membrane for substantially separating the first liquid flow path and the second liquid flow path corresponding to the first liquid flow path from each other at all times, the liquid ejecting head includes an atmosphere communication port facing the atmosphere for communicating the second liquid flow path with the atmosphere, and an atmosphere communication path having an atmosphere communication path introduction port facing the second liquid flow path, wherein the atmosphere communication port is formed through the same surface as that of the ejecting port.

The liquid ejecting head arranged as described above includes the atmosphere communication path for communicating the second liquid flow path, in which the bubble forming liquid exists, with the atmosphere and removes remaining bubbles generated in the second liquid flow path from the atmosphere communication path. That is, the liquid ejecting head is provided only with the communication path for communicating the second liquid flow path with the atmosphere as an arrangement for removing the remaining bubbles, and it is not necessary to provide the liquid ejecting head with a collection path for collecting the remaining bubbles, a mechanism for circulating the bubble forming liquid, and the like. Further, since the atmosphere communication path and the ejecting port are formed through the same surface, when the liquid to be ejected in the ejecting port is drawn by a drawing device having a drawing unit abutted against the ejecting port in order to restore, for example, the ejecting capability of the ejecting port, the remaining bubbles in the atmosphere communication path also can be drawn and removed without changing a direction in, which the drawing unit of the drawing device is abutted simultaneously with the restoration of the ejecting capability.

In a liquid ejecting head of the present invention, when the ejecting port has an area $S_0$ and the atmosphere communication port has an area $S_1$, a relationship of $S_1 \leqq S_0$ may be established. When the above relationship is established, in particular, when the atmosphere communication path, the atmosphere communication path introduction port, and the atmosphere communication port have the same sectional area and the area of the atmosphere communication port is smaller than that of the ejecting port as represented by $S_1<S_0$, it scarcely occurs that the bubble forming liquid is ejected from the atmosphere communication port of the atmosphere communication path by the influence of ejection of the liquid from the ejecting port. Further, when the ejecting port has an area $S_0$, the atmosphere communication port has an area $S_1$ and the atmosphere communication path introduction port has an area $S_2$, relationships of $S_0<S_1$ and $S_2<S_1$ may be established. When the above relationships are established, the area of the atmosphere communication path introduction port is smaller than that of the atmosphere communication port. Thus, first, it is difficult for ejection energy to be transmitted up to the atmosphere communication port through the atmosphere communication path introduction port. Further, since the area of the atmosphere communication port is large than that of the ejecting port, a large amount of ejection energy is necessary to eject the bubble forming liquid from the atmosphere communication port, which makes it difficult for the bubble forming liquid to be ejected from the atmosphere communication port. As a result, it is possible to dispose the atmosphere communication path introduction port in the vicinity of a bubble generating region where a bubble is generated in the bubble forming liquid by a heating element, which increases a remaining bubble removing efficiency.

When it is supposed that a supply source of the bubble forming liquid is located upstream, the atmosphere communication path introduction port may be formed downstream of the heating element. In this case, since the atmosphere communication path introduction port is formed downstream, it can be prevented that the bubble forming liquid stagnates downstream of the heating element of the second liquid flow path.

An expanded section, which has an sectional area sufficient to pevent bubble forming liquid from rising up to the atmosphere communication port from the atmosphere communication path introduction port by capillary force, may be formed in the midway of the atmosphere communication path. In this case, since the liquid boundary of the bubble forming liquid cannot pass the expanded section, even if the bubble forming liquid is ejected from the atmosphere communication path introduction port, it is ejected into the expanded section. Thus, the bubble forming liquid is not directly ejected to the outside from the atmosphere communication port. Further, the projecting surface of the atmosphere communication port and the atmosphere communication path introduction port of the atmosphere communication path may not overlap each other. In this case, even if the bubble forming liquid is ejected from the atmosphere communication path introduction port, it is not ejected to the atmosphere communication port but is ejected to a wall surface which forms the expanded section. As a result, direct ejection of the bubble forming liquid to the outside from the atmosphere communication port can be more reliably prevented. Further, a plurality of the atmosphere communication path introduction ports may be formed with respect to one atmosphere communication path or a plurality of the atmosphere communication paths may be formed.

When the plurality of atmosphere communication paths are formed, a desired opening area required to the atmosphere communication path introduction ports of the atmosphere communication paths and the atmosphere communication ports can be shared by the respective atmosphere communication paths. That is, when necessary, the opening areas of the respective atmosphere communication path introduction ports and the respective atmosphere communication ports can be reduced. The movable separation membrane may be an organic film formed by a deposition method by chemical vapor reaction or plasma polymerization reaction. In this case, the movable separation membrane may contain ployparaxylene.

A head cartridge of the present invention includes a liquid ejecting head photographic film the present invention and an ink tank for holding a liquid to be ejected by the liquid ejecting head.

In the head cartridge arranged as described above, the liquid ejecting head includes the atmosphere communication path for communicating the second liquid flow path, in which the bubble forming liquid exists, to the atmosphere and removes remaining bubbles generated in the second liquid flow path from the atmosphere communication path. That is, the liquid ejecting head of the head cartridge is provided only with the communication path for communicating the second liquid flow path with the atmosphere as an arrangement for removing the remaining bubbles, and it is not necessary to provide the liquid ejecting head with a collection path for removing the remaining bubbles, a mechanism for circulating the bubble forming liquid, and the like. Further, in the liquid ejecting head provided with the head cartridge of the present invention, since the atmosphere communication path and the ejecting port are formed through the same surface, when the liquid to be ejected in the ejecting port is drawn by a drawing device having a drawing unit abutted against the ejecting port in order to restore, for example, the ejecting capability of the ejecting port, the remaining bubbles in the atmosphere communication path also can be drawn and removed without changing a direction in which the drawing unit of the drawing device is abutted simultaneously with the restoration of the ejecting capability.

A liquid ejecting apparatus of the present invention includes a liquid ejecting head of the present invention, an ink tank for holding a liquid to be ejected by the liquid ejecting head, and a mounting section on which the liquid ejecting head is mounted.

The liquid ejecting apparatus of the present invention arranged as described above includes the atmosphere communication path for communicating the second liquid flow path, in which the bubble forming liquid exists, to the atmosphere and removes remaining bubbles generated in the second liquid flow path from the atmosphere communication path. That is, the head cartridge is provided only with the communication path for communicating the second liquid flow path with the atmosphere as an arrangement for removing the remaining bubbles, and it is not necessary to provide the liquid ejecting head with a collection path for removing the remaining bubbles, a mechanism for circulating the bubble forming liquid, and the like. Further, in the liquid ejecting head provided with the liquid ejecting apparatus of the present invention, since the atmosphere communication path and the ejecting port are formed through the same surface, when the liquid to be ejected in the ejecting port is drawn by a drawing device having a drawing unit abutted against the ejecting port in order to restore, for example, the ejecting capability of the ejecting port, the remaining bubbles in the atmosphere communication path also can be drawn and removed without changing a direction in which the drawing unit of the drawing device is abutted simultaneously with the restoration of the ejecting capability.

A liquid ejecting apparatus of the present invention may include a drawing device for drawing a liquid to be ejected from the ejecting port of the liquid ejecting head as well as for drawing a bubble forming liquid and remaining bubbles from the atmosphere communication path. Further, the drawing device may draw the liquid to be ejected as well as the bubble forming liquid and the remaining bubbles simultaneously or may draw the liquid to be ejected and the remaining bubbles individually.

Further objects, features and advantages of the present invention will become apparent from the following description of the preferred embodiments.

BRIEF DESCRIPTION OF THE DRAWINGS

FIGS. 1A and 1B show sectional views of a liquid ejecting head of a first embodiment of the present invention taken along a direction of a liquid flow path, wherein FIG. 1A shows a state when no bubble is formed and FIG. 1B shows a state in which a bubble is formed;

FIGS. 5A and 5B are sectional views showing a liquid ejecting head of a third embodiment of the present invention taken along a direction of a liquid flow path, wherein FIG. 5A shows a state when no bubble is formed and FIG. 5B shows a state in which a bubble is formed;

DESCRIPTION OF THE PREFERRED EMBODIMENTS

Embodiments of the present invention will be described below with reference to the accompanying drawings.

Note that while the same symbols $S_0$, $S_1$, $S_2$, and $S_3$ are used in the respective embodiment to indicate an area in the following description, the same symbols may indicate a different area in the respective embodiments, respectively.

First Embodiment

Figure 1A:
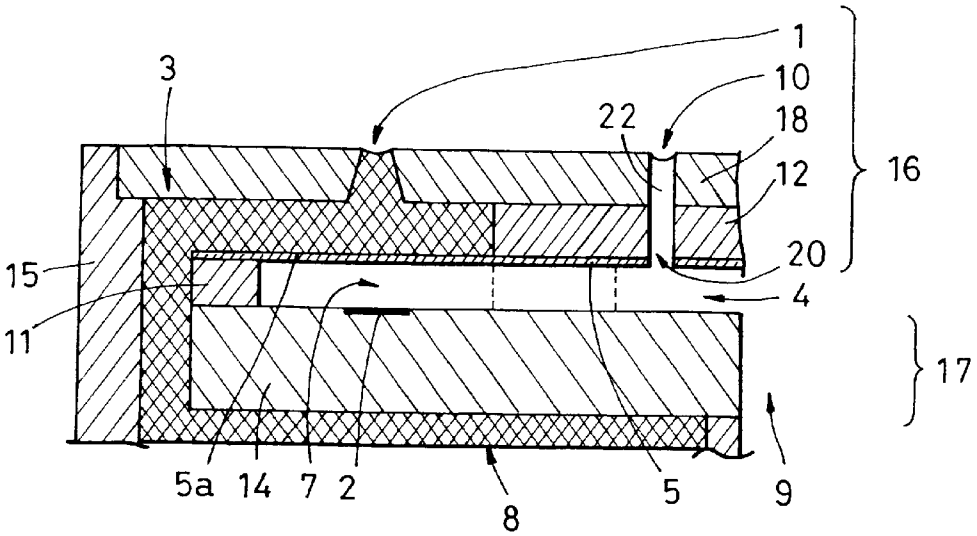
Figure 1B:
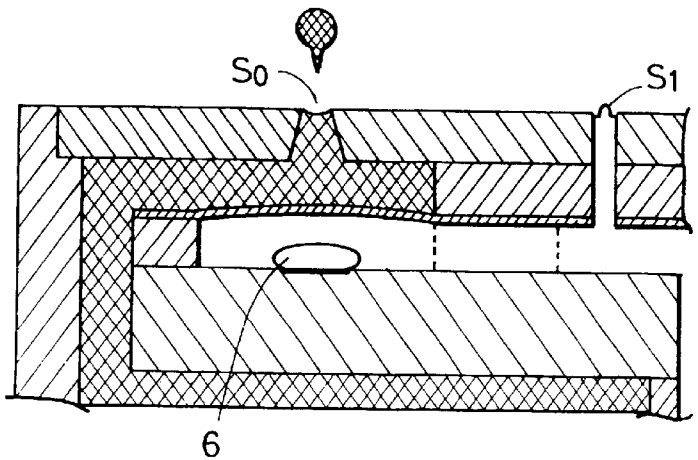
Figure 2:
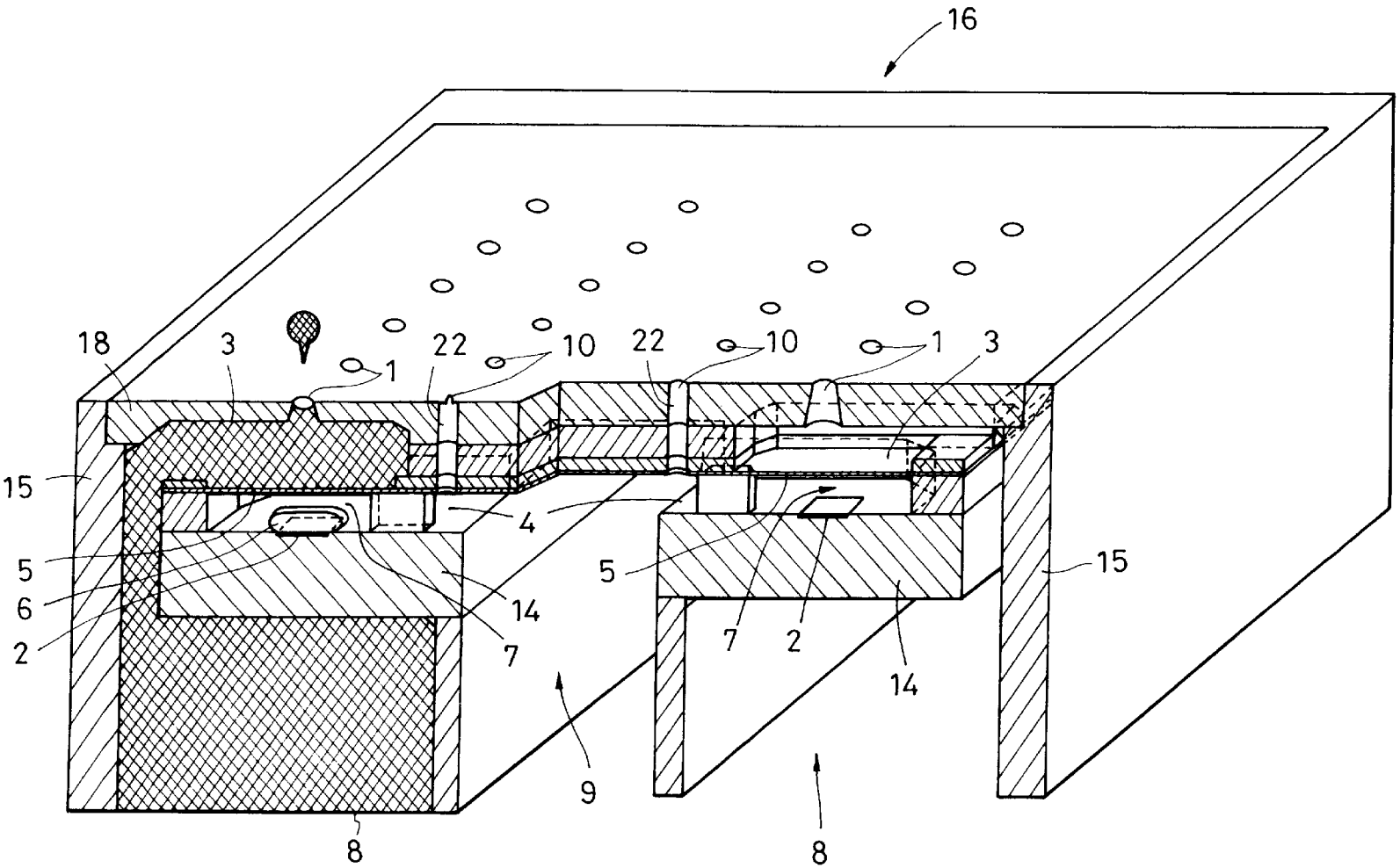
FIG. 2 is an exploded perspective view of the liquid ejecting head shown in FIG. 1.

FIGS. 1A and 1B are sectional views of one of nozzle arrays of a liquid ejecting head of a first embodiment of the present invention taken along a direction of a liquid flow path, and FIG. 2 is an exploded perspective view of the liquid ejecting head shown in FIG. 1.

The liquid ejecting head of the first embodiment includes a liquid ejecting head base member 17, a grooved member 16 jointed on the liquid ejecting head base member 17, and a side wall 15 jointed to the grooved member 16. Further, the liquid ejecting head base member 17 includes an element substrate 14 on which a plurality of heating elements 2 are disposed in parallel with each other to apply energy for generating bubbles to a liquid, respectively.

In the liquid ejecting head base member 17, an elastic movable separation membrane 5 is mounted through an adhesive on a pedestal 11 which is disposed on the element substrate 14 on which the heating elements 2 are formed. The portion of the movable separation membrane 5, which faces each heating element 2, is arranged as a movable portion 5*a* which is supported spaced apart from the element substrate 14 without coming into contact with the pedestal 11. A plurality of second liquid flow paths 4, through which a bubble forming liquid is supplied, are formed by the element substrate 14, the pedestal 11, and the movable separation membrane 5 in correspondence to the respective heating elements 2.

Further, a wiring (not shown), which is connected to the respective heating elements 2, is formed on the element substrate 14. In addition, the element substrate 14 further includes a contact pad to be described later which acts as an input terminal for an external electric signal. Application of a voltage to desired heating elements 2 from the contact pad through the wiring permits them to be individually driven.

The grooved member 16 is used to form a plurality of first liquid flow paths 3 which correspond to the respective heating elements 2 and to which a liquid to be ejected is supplied. The grooved member 16 is composed of a top board 18 and a first flow path wall 12, which are formed integrally with each other. The first flow path wall 12 is used to partition the respective first liquid flow paths 3. The top board 18 includes a plurality of ejecting ports 1, which are formed therethrough so as to communicate with the respective first liquid flow paths 3, and an atmosphere communication port 10, which also is formed therethrough, for an atmosphere communication path 22 communicating with respective second liquid flow paths.

The first liquid flow paths 3 are completely separated from the second liquid flow paths 4 by the movable separation membrane 5. The liquid to be ejected in the first liquid flow paths 3 and the bubble forming liquid in the second liquid flow path 4 are supplied through different supply paths, respectively, that is the former liquid supplied from a first common liquid chamber 8 and the latter liquid is supplied from a second common liquid chamber 9.

The respective ejecting ports 1, which eject the liquid to be ejected and have an opening area $S_0$, are formed at positions where they face the heating elements 2 across the movable separation membrane 5.

The atmosphere communication port 10 is formed to the atmosphere communication path 22 on a side facing the atmosphere which is the same surface as that where the ejecting ports are formed, whereas an atmosphere communication path introduction port 20 is formed on a side facing the second liquid flow path 4. The atmosphere communication port 10 may have any opening area so long as it can maintain a meniscus. In the first embodiment, however, the opening area is set to $S_1$ which is smaller than the opening area $S_0$ of the ejecting ports 1, and the atmosphere communication port 10 is formed at a position spaced apart from a bubble generating region 7 located between the portion of the movable separation membrane 5 facing a heating element 2 and the heating element 2. Further, in the first embodiment, the sectional area of the atmosphere communication path 22 and the opening area of the atmosphere communication path introduction port 20 are the same as the opening area $S_1$ of the atmosphere communication port 10. As described later, the atmosphere communication path 22 is formed to discharge remaining bubbles generated in the second liquid flow path 4 to the outside. However, the atmosphere communication path 22 does not adversely affect the liquid which is ejected from the ejecting ports 1 because it does not communicate with the first liquid flow paths 3 as well as formed at the position spaced apart from the bubble generating region 7. Further, the opening area $S_1$ of the atmosphere communication port 10 is smaller than the opening area $S_0$ of the respective ejecting ports 1, which makes it difficult to cause such a phenomenon that the bubble forming liquid is ejected from the atmosphere communication port 10. Note that a dimensional relationship between the opening area of the atmosphere communication port 10 and that of the ejecting ports 1 is not limited to the above, and the opening area $S_1$ of the atmosphere communication port 10 may be the same as or larger than the opening area $S_0$ of the ejecting ports 1.

The liquid to be ejected is supplied from an ink tank or the like, which will be described later, to the first common liquid chamber 8 and ejected from the ejecting ports 1 through the first liquid flow paths 3. The bubble forming liquid is supplied from the second common liquid chamber 9 to the second liquid flow paths 4 and fills them.

The movable separation membrane 5 will be described in detail.

The movable separation membrane 5 is jointed on the upper surface of the pedestal 11 and the portion thereof which is not jointed to the pedestal 11 and is located in the bubble generating region 7 is arranged as the movable portion 5*a*. The movable separation membrane 5 is composed of a polyparaxylene film formed by CVD to a film thickness of about 2 im. A basic structure, manufacturing method, polymerization method, and the like of the polyparaxylene used in the present invention are disclosed in U.S. Pat. No. 3,379,803, Japanese Patent Publication Nos. 44-21353 and 52-37479, and the like.

The polyparaxylene film is excellent in heat resistance and has excellent resistance to chemicals such as various kinds of organic solvents, acids and alkalis as well as it is also excellent in a property for shutting off various base members and in a property for following the expansion and contraction of them. Further, the polyparaxylene film can be coated to minute portions and to portions having a complex shape in a conformal fashion (in the same shape) because it is formed by a vapor phase polymerization method.

It should be noted that the liquid ejecting head base member 17 can be jointed to the top board 18 by a low temperature (ordinary temperature) joint (hereinafter, simply referred to as ordinary temperature joint) making use of surface activation by removing the portion of the movable separation membrane 5 (polyparaxylene film) interposed between the pedestal 11 of the liquid ejecting head base member 17 and the first flow path wall 12 of the grooved member 16.

An ordinary temperature joint apparatus used at that time includes two vacuum chambers composed of a preliminary chamber and a pressure joint chamber, and each chamber has a degree of vacuum set to 1 to 10 Pa. Then, the pedestal 11 of the liquid ejecting head base member 17 is aligned with the first flow path wall 12 of the grooved member 16 by image processing in the preliminary chamber. Thereafter, they are transported to the pressure joint chamber while maintaining the state thereof, and energy particles are irradiated onto the surface of a SiN film of the portions thereof to be jointed by a saddle field type high speed electron beams. After the surface is activated by the irradiation, the liquid ejecting head base member 17 is jointed to the top board 18. At that time, they may be heated to 200° C. or less subjected to pressure to increase strength.

It should be noted that when the nozzle arrays are disposed at a low density, polyparaxylene is removed from only the region where the pedestal 11 is jointed to the first flow path wall 12. When the nozzle arrays are disposed at a high density, however, it is preferable to remove polyparaxylene from a region larger than the region where the pedestal 11 is jointed to the first flow path wall 12 with an allowance of 5 to 10 $\mu$m from the view point of accuracy when the grooved member 16 is in intimate contact with (or jointed to) the liquid ejecting head base member 17.

Further, available as the above joint method is such that a thin film (3000 Å) of water glass (sodium silicate) may be applied to the joint portion on the liquid ejecting head base member 17 and patterned, and then the liquid ejecting head base member 17 is jointed to the grooved member 16 after it is heated to about 100° C., or an adhesive is applied to any one of the grooved member 16 and the liquid ejecting head base member 17 by a transfer method or the like and then they are jointed to each other by being heated and pressurized.

Next, a manufacturing process of the liquid ejecting head of the present invention will be described.

To describe roughly, the liquid ejecting head was manufactured such that the wall of the second liquid flow paths 4 was formed on the element substrate 14, the movable separation membrane 5 was mounted on the wall, and further the grooved member 16, on which grooves for constituting the first liquid flow paths 3, and the like, were formed, was mounted on the movable separation membrane 5. Otherwise, the liquid ejecting head was manufactured by forming the wall of the second liquid flow paths 4 and jointing the grooved member 16, on which the movable separation membrane 5 was mounted, on the wall.

Further, a method of manufacturing the second liquid flow paths 4 will be described in detail.

First, the heating elements 2 as electro-thermal transducers composed of hafnium boride, tantalum nitride, or the like were formed on the element substrate 14 (silicon wafer) using the same manufacturing apparatus as that used for manufacturing a semiconductor and thereafter the surface of the element substrate 14 was rinsed so that it was in good intimate contact with a light sensitive resin in the next process. Further, to improve the intimate contact property, a liquid obtained by diluting, for example, a silane coupling material (A189 made by Nippon Unicar) with 1% of ethyl alcohol may be spin coated on the surface of the element substrate 14 after the surface is improved with ultra-violet rays—ozone or the like.

Next, an ultraviolet ray sensitive resin film (dry film, Ordyl SY-318 made by Tokyo Ohka Kogyo) was laminated on the element substrate 14 the surface of which was rinsed to improve the intimate contact property thereof.

Next, a photomask was disposed on the dry film and ultraviolet rays were irradiated to a portion of the dry film which was to be remained as the walls of the second liquid flow paths 4 through the photo mask. The exposure process was carried out with an amount of exposure light of about $600\times10^4$ mj/m$^2$ using MPA-600 made by CANON KABUSHIKI KAISHA.

Then, the dry film was developed with a developer composed of a mixed solution of xylene and butyl cellosolve acetate (BMRC-3 made by Tokyo Ohka Kogyo) so as to dissolve an unexposed portion, and the portion, which was exposed and hardened, was formed as the walls of the second liquid flow paths 4. Further, residuals remaining on the surface of the element substrate 14 were remove by being processed by an oxygen plasma ashing apparatus (MAS-800 made by Alcantech) for about 90 seconds. Subsequently, the dry film was further irradiated with ultraviolet rays of $100\times10^4$ mj/m$^2$ for two hours at 150° C. so that the exposed portion was perfectly hardened.

With the above method, the second liquid flow paths 4 could be uniformly formed with pinpoint accuracy on each of a plurality of liquid ejecting head base members 17 made by dividing the silicon substrate. That is, the silicon substrate was cut and separated to the respective liquid ejecting head base members 17 by a dicing machine (AWD-4000 made by Tokyo Seimitsu) on which a diamond blade having a thickness of 0.05 mm was mounted. The thus separated liquid ejecting head 17 was fixed on an aluminum base plate through an adhesive (SE 4400 made by Toray).

Next, a printed circuit board was connected to the liquid ejecting head base member 17 by an aluminum wire having a diameter of 0.05 mm.

Next, a member composed of the grooved member 16 jointed to the movable separation membrane 5 was aligned with and jointed to the thus obtained liquid ejecting head base member 17 by the above-mentioned method.

That is, after the grooved member 16 having the movable separation membrane 5 was aligned with and fitted and fixed to the liquid ejecting head base member 17, the portions between the aluminum wires, the gaps between the aluminum wires and between the grooved member 16 and the liquid ejecting head base member 17 was sealed with a silicone sealant (TSE399 made by Toshiba Silicone), and the second liquid flow paths 4 were completed.

The formation of the second liquid flow paths 4 by the above method permits the flow paths to be formed accurately which is not in misalignment with the heating elements 2 of each liquid ejecting head base member 17. The above manufacturing method of high accuracy permits the liquid ejecting head to perform an ejecting operation stably and quality of prints to be improved. Further, a lot of liquid ejecting heads can be manufactured at low cost by the collective formation thereof on a wafer.

It should be noted that while the ultraviolet ray hardening type dry film was used in the first embodiment to form the second liquid flow paths 4, they can also be obtained in such a manner that after a resin having a light absorbing region in an ultraviolet region, in particular, in the vicinity of 248 nm is hardened after it is laminated and the portion of the resin used as the second liquid flow paths 4 is directly removed by eximer laser.

Further, the first liquid flow paths 3 and the like were formed by jointing the grooved member 16 to the coupled member composed of the above-mentioned liquid ejecting head base member 17 and movable separation membrane 5.

Further, prefrably used as the material of the movable separation membrane 5 are polyethylene, polypropylene, polyethylene terephthalate, melamine resin, phenol resin, polybutadiene, polyurethane, polyether ether ketone, polyether sulphone, polyallylate, silicon rubber, polysulphone, resin represented by recent engineering plasstic, which is excellent in heat resistance, solvent resistance, and a molding property, having elasticity and can be made to a thin film and the compounds thereof, in addition to the above-mentioned polyparaxylene.

Further, while the thickness of the movable separation membrane 5 may be determined in consideration of the material, shape and the like thereof from the view point that it can achieve strength as a separation wall and be excellently expanded and contracted, it is preferable to set the thickness to about 0.5 $\mu$m to 10 $\mu$m.

Note that, while the elastic movable separation membrane 5 is used in the first embodiment, a movable separation membrane 5, which is previously loosened so as to be easily displaced, may be used.

Next, how the liquid ejecting head of the present invention ejects a liquid will be described with reference to FIGS. 1A and 1B.

As shown in FIG. 1, the interior of a first liquid flow paths 3, which directly communicates with an ejecting port 1, is filled with a liquid to be ejected which is supplied from the first common liquid chamber 8, and the second liquid flow path 4 having the bubble generating region 7 is filled with a bubble forming liquid which forms a bubble when thermal energy is applied thereto by a heating element 2.

In an initial state, the liquid to be ejected in the first liquid flow path 3 is drawn to the vicinity of the ejecting port 1 by capillary force. When thermal energy is applied to the heating element 2 in this state, the heating element 2 is rapidly heated and the surface thereof in contact with the bubble forming liquid in the bubble generating region 7 heats the bubble forming liquid so that a bubble is formed from the bubble forming liquid. The bubble 6 formed by the heating and bubble froming operation is a bubble formed based on a film boiling phenomenon as disclosed in U.S. Pat. No. 4,723,129 and generated on the entire surface area of the heating element 2 all at once with very high pressure. The pressure generated at this time is transmitted to the bubble forming liquid in the second liquid flow path 4 as a pressure wave and acts on the movable separation membrane 5, which causes a movable portion 5*a* of the movable separation membrane 5 to be displaced so that the liquid in a first liquid flow path 3 starts to be ejected.

When the bubble 6 generated on the overall surface of the heating element 2 grows rapidly, it is made to a film-like bubble. The movable portion 5*a* is further displaced by the bubble 6 which is expanded by the very high pressure at the initial time of the generation thereof, whereby the ejection of the liquid in the first liquid flow path 3 from the ejecting port 1 is further proceeded. Thereafter, when the bubble 6 further grows, the displacement of the movable portion 5*a* is increased. When the bubble 6 breaks thereafter, the movable portion 5*a* is displaced by the restoring force thereof so as to return to its initial position.

A fine bubble is generated in the bubble forming liquid having been formed to bubbles in the second liquid flow path 4 because the bubble 6 is generated in the bubble forming liquid to eject the liquid as described above depending upon drive conditions. The remaining bubble is not accumulated in the bubble forming liquid in the second liquid flow path 4 because they are ejected from the atmosphere communication port 10.

The remaining bubble may be discharged from the atmosphere communication port 10 by drawing it by a draw and restoration device, which will be described later, simultaneously with the restoring operation of the ejecting port 1 performed by the draw and restoration device. Otherwise, it may be drawn by the draw and restoration device at a timing different from that at which the ejecting port 1 is restored thereby. The ejecting port 1 and the atmosphere communication port 10 are formed through the same surface, which permits the draw and restoration device to perform a drawing operation without changing a direction of a drawing unit which is abutted against the surface of the top board 18 on which the ejecting port 1 and the atmosphere communication port 10 are formed. Further, when a tube pump is particularly used as the draw and restoration device, the internal pressure of the bubble forming liquid in the second liquid flow path 4 is varied and vibrates the movable separation membrane 5, more smoothly moving the remaining bubble to the atmosphere communication port 10. As described above, the use of the draw and restoration device, which is used to restore the ejecting port 1, for the purpose of drawing the remaining bubble can prevent the liquid ejecting head from becoming complex.

Further, formation of the atmosphere communication port 10 at the position apart from the bubble generating region 7 prevents pressure as ejection energy, which is generated when the bubble 6 grows, from escaping to a collection path, different from an arrangement in which the collection path is provided to circulate a bubble forming liquid to remove a remaining bubble. With the above arrangement, not only the loss of bubble forming power is reduced and an ejection efficiency is improved but also the bubble forming liquid is difficult to be ejected from the atmosphere communication port 10 as described above. Further, no collection path is necessary because the bubble forming liquid is not circulated, which makes it easier to manufacture the liquid ejecting head.

Further, while the bubble forming liquid is heated by the heating element 2, the heat thereof is radiated when it is evaporated from the atmosphere communication port 10. The bubble forming liquid, which has been consumed by being evaporated is naturally supplied from the second common liquid chamber 9 because it is drawn to the vicinity of the atmosphere communication port 10 by the capillary force at all times.

It should be noted that exemplified as the bubble forming liquid are specifically methanol, ethanol, n-propanol, isopropaol, n-hexane, n-heptane, n-octane, toluene, xylene, methylene dioxide, trichloroethylene, Freon TF, Freon BF, ethyl ether, dioxane, cyclohexane, methyl acetate, ethyl acetate, acetone, methyl ethyl ketone, water, etc. and mixtures thereof. Further, various types of liquids can be used as the liquid to be ejected regardless of the bubble forming property and the thermal property thereof. Furthermore, a liquid which is conventionally difficult to be ejected because it has an inferior bubble forming property and even a liquid the quality of which is liable to be altered and deteriorated by heat and even a liquid having high viscosity, and the like can be utilized.

However, it is desirable as the property of the liquid to be ejected that ejection of the liquid, formation of a bubble and the operation of the movable separation membrane 5 are not prevented by the liquid to be ejected itself or the reaction thereof with the bubble forming liquid. In addition to the above liquids, liquids such as pharmaceuticals, perfumes, and the like can also be utilized.

Liquids having the following compositions were combined as the bubble forming liquid and the liquid to be ejected and images were recorded using them. As a result, not only liquids having viscosity of an order of 0.01 Pa.s but also a liquid having very high viscosity of 0.15 Pa.s, which could not be ejected by a conventional liquid ejecting apparatus, could be excellently ejected and records of high quality could be obtained thereby.

| | | |
|---|---|---|
| Bubble forming liquid 1 | Ethanol | 40% |
| | Water | 60% |
| Bubble forming liquid 2 | Water | 100% |
| Bubble forming liquid 3 | Isopropyl alcohol | 10% |
| | Water | 90% |
| Liquid to be ejected 1 | Carbon black | 5% |
| (pigment ink: about 0.015 Pa · s) Styrene - acrylic acid - ethyl acrylate copolymer | | |
| (amount of oxidation: 140, average molecular weight by weight: 8000) | | |
| | Above dispersant | 1% |
| | Monoethanol amine | 0.25% |
| | Glycerin | 6.9% |
| | Thiodiglycol | 5% |
| | Ethanol | 3% |
| | Water | 16.75% |
| Liquid to be ejected 2 (0.055 Pa · s) | Polyethylene glycol 200 | 100% |
| Liquid to be ejected 3 (0.15 Pa · s) | Polyethylene glycol 600 | 100% |

Incidentally, when the liquids, which were conventionally considered to be difficult to be ejected, were ejected, their dispersion in an ejecting direction was encouraged by a slow ejection speed so that dots impact on a recording sheet with bad accuracy, and further an amount of ejection of the liquids was dispersed due to unstable ejection, thus it was difficult to obtain an image of high quality from the liquids. With the above arrangement, however, the pressure of a bubble could be stably transmitted to the liquids to be ejected. Accordingly, the impact accuracy of the droplets of the liquids could be improved and the amount of inks to be ejected could be stabilized, whereby the quality of a recorded image could be greatly improved.

As described above, according to the liquid ejecting head of the first embodiment, the liquid ejecting head includes the atmosphere communication path 22 for communicating the second liquid flow paths 4, in which the bubble forming liquid exists, to the atmosphere, and remaining bubbles generated in the second liquid flow paths are removed from the atmosphere communication path 22, which eliminates the need of a collection path for collecting the remaining bubbles, a mechanism for circulating the bubble forming liquid and the like. As a result, the remaining bubbles can be removed by the simple structure. Further, The ejection energy can be effectively transmitted to the liquid to be ejected and the ejection efficiency can be improved because the bubble generating region is very tightly sealed as compared with the arrangement in which the bubble forming liquid is circulated.

Moreover, since the atmosphere communication port 10 and the ejecting ports 1 are formed through the same surface, the remaining bubbles in the atmosphere communication path 22 can be reliably drawn by, for example, the draw and restoration device for restoring the ejection capability of the ejection ports without the addition of a mechanism dedicated for the forcible removal of the remaining bubbles in the atmosphere communication path 22. Since the atmosphere communication port 10 and the ejecting ports 1 are formed through the same surface, the draw and restoration device can perform a drawing operation without changing the abutting direction of the drawing unit. Further, the draw and restoration device can perform the drawing operation of the ejecting ports 1 and the drawing operation of the atmosphere communication port 10 at the same time or perform them separately by disposing the ejecting ports 1 at spaced intervals with the atmosphere communication port 10.

Second Embodiment

Figure 3:
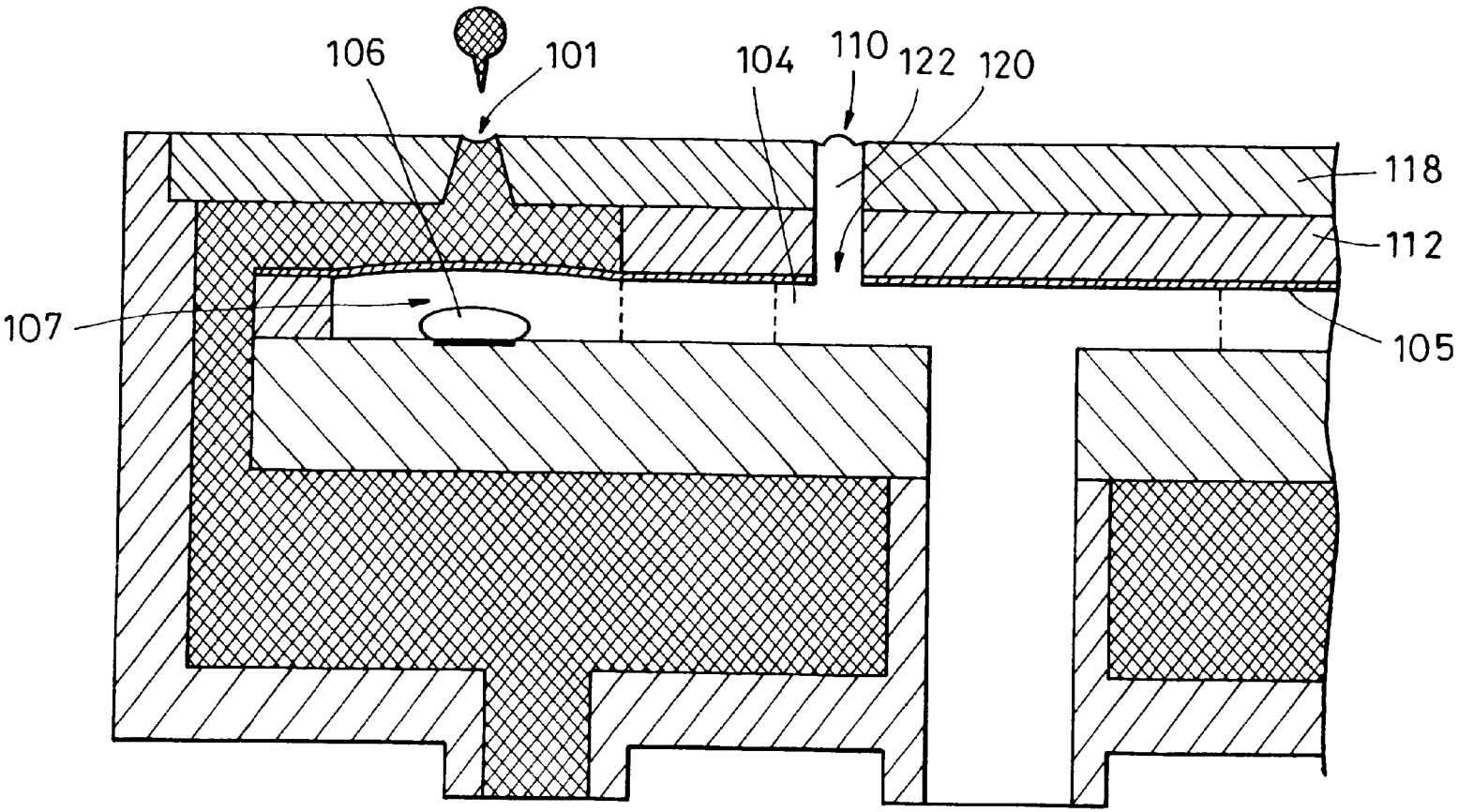
FIG. 3 is a sectional view of a liquid ejecting head of a second embodiment of the present invention taken along a direction of a liquid flow path.
Figure 4A:
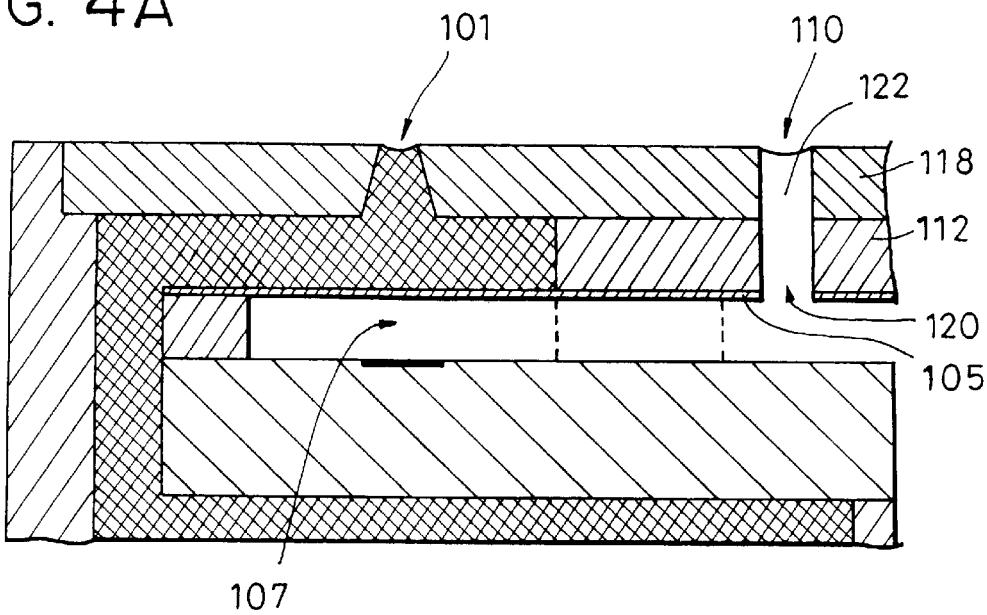
FIG. 4A is a view showing a state of the liquid ejecting head shown in FIG. 3 when no bubble is formed.
Figure 4B:
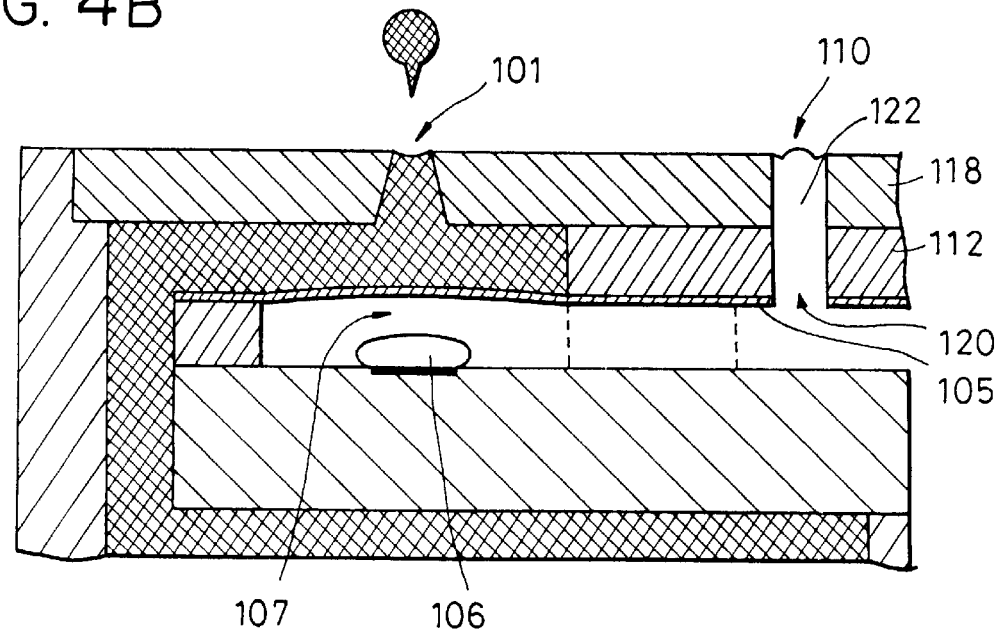
FIG. 4B is a view when a bubble is formed.

Next, FIG. 3 shows a sectional view of a liquid ejecting head of a second embodiment taken along a direction of a liquid flow path, FIG. 4A is a view showing a state of the liquid ejecting head shown in FIG. 3 when no bubble is formed, and FIG. 4B is a view when a bubble is formed, respectively.

An ejecting port 101 having an opening area $S_0$ and an atmosphere communication port 110 having an opening area $S_1$ are formed through a top board 118. While an atmosphere communication path 122, which communicates with the atmosphere communication port 110, has an opening area $S_1$, an atmosphere communication path introduction port 120, which is formed through a first flow path wall 112 and a movable separation membrane 105 to communicate the atmosphere communication path 122, has a sectional area $S_2$ which is smaller than the sectional area $S_1$. Further, the respective sectional areas have relationships of $S_0<S_1$ and $S_2<S_1$.

Since the other arrangement of the liquid ejecting head of the second embodiment is basically the same as that shown in the first embodiment, the detailed description thereof is omitted.

As described above, ejection of a bubble forming liquid from the atmosphere communication port 110 requires ejection energy larger than that necessary to eject a liquid to be ejected from the ejecting port 101 because the opening area $S_1$ of the atmosphere communication port 110 is larger than the opening area $S_0$ of the ejecting ports 101. Accordingly, it can be said that in the second embodiment it is difficult to eject the bubble forming liquid from the atmosphere communication port 110. In addition to the above, it is difficult to transmit ejection energy, which is generated when a bubble 106 grows, up to the atmosphere communication port 110 passing through the atmosphere communication path introduction port 120 because the section area of the atmosphere communication path introduction port 120 is smaller than that of the atmosphere communication port 110. Thus, loss of bubble forming power can be reduced. In addition, it is possible to dispose the atmosphere communication port 110 nearer to a bubble generating region 107, improving a remaining bubble removing ratio.

As described above, according to the liquid ejecting head of the second embodiment, remaining bubbles can be reliably removed by a simple structure similarly to the liquid ejecting head of the first embodiment, and moreover a liqud ejecting efficiency can be improved as compared with a liquid ejecting head having a bubble forming liquid collection path.

Third Embodiment

Figure 5A:
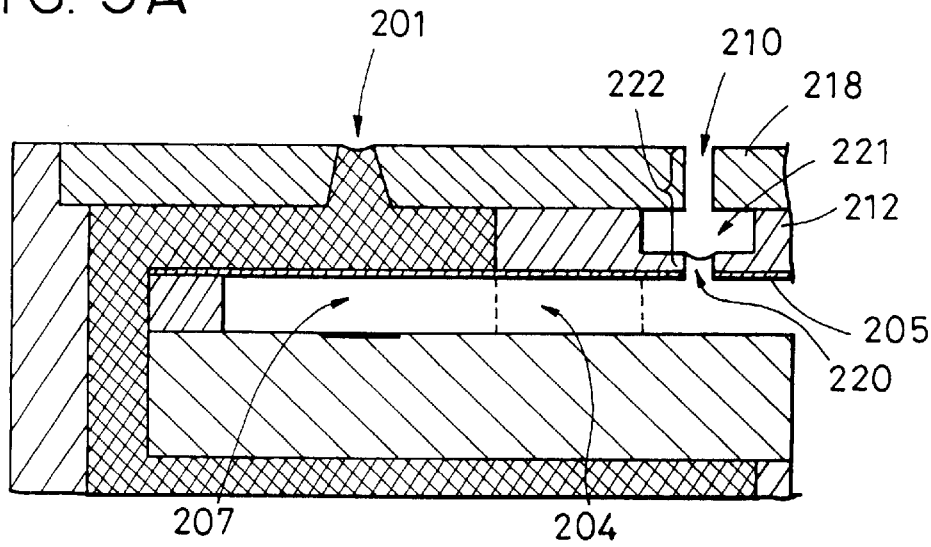
Figure 5B:
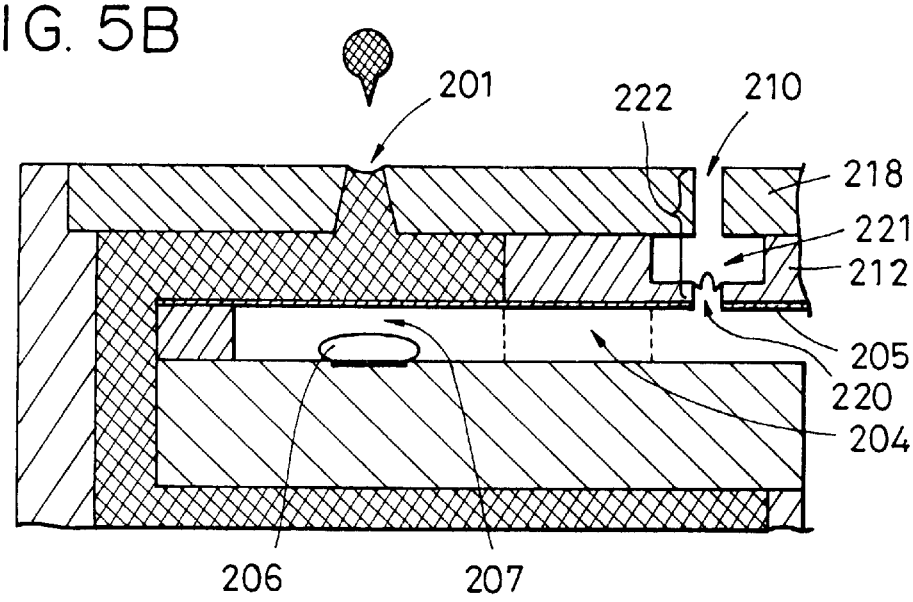

Next, FIG. 5A shows a sectional view of a liquid ejecting head of a third embodiment taken along a direction of a liquid flow path when no bubble is formed, and FIG. 5B shows a state when a bubble is formed, respectively.

An ejecting port 201 having an opening area $S_0$ and an atmosphere communication port 210 having an opening area $S_1$ are formed through a top board 218. Further, an expanded section 221 having a section area $S_3$ is formed through a second flow path wall 213 so as to communicate with the atmosphere communication port 210, and an atmosphere communication path introduction port 220 having a section area $S_2$ is formed through a first flow path wall 212 and a movable separation membrane 205 so as to communicate with the expanded section 221. The respective areas $S_1$, $S_2$, and $S_3$ of the atmosphere communication port 210, the expanded section 221 and the atmosphere communication path introduction port 220 have relationships of $S_1<S_3$ and $S_2<S_3$. Further, the sectional area $S_3$ of the expanded section 221 is set to such a degree that a bubble forming liquid is not risen up to the atmosphere communication port 210 by capillary force. As described above, an atmosphere communication path 222 of the third embodiment has the expanded section 221 interposed between the atmosphere communication port 210 and the atmosphere communication path introduction port 220.

Since the other arrangement of the liquid ejecting head of the third embodiment is basically the same as that shown in the first embodiment, the detailed description thereof is omitted.

As described above, the expanded section 221 having the large section area is formed between the atmosphere communication port 210 and the atmosphere communication path introduction port 220. Accordingly, when a liquid is ejected from the ejecting port 201 by generating a bubble 206, even if a bubble forming liquid is ejected from the atmosphere communication path introduction port 220 by the ejection energy of the bubble 206, the bubble forming liquid is captured by the expanded section 221. Therefore, even if the atmosphere communication port 210 and the atmosphere communication path introduction port 220 are formed in the vicinity of a bubble generating region 207, there is not a possibility that the bubble forming liquid is ejected to the outside from the atmosphere communication port 210.

As described above, according to the liquid ejecting head of the third embodiment, remaining bubbles can be reliably removed by a simple structure similarly to the liquid ejecting heads of the first and second embodiments, and moreover a liquid ejecting efficiency can be improved as compared with a liquid ejecting head having a collection path.

Fourth Embodiment

Figure 6:
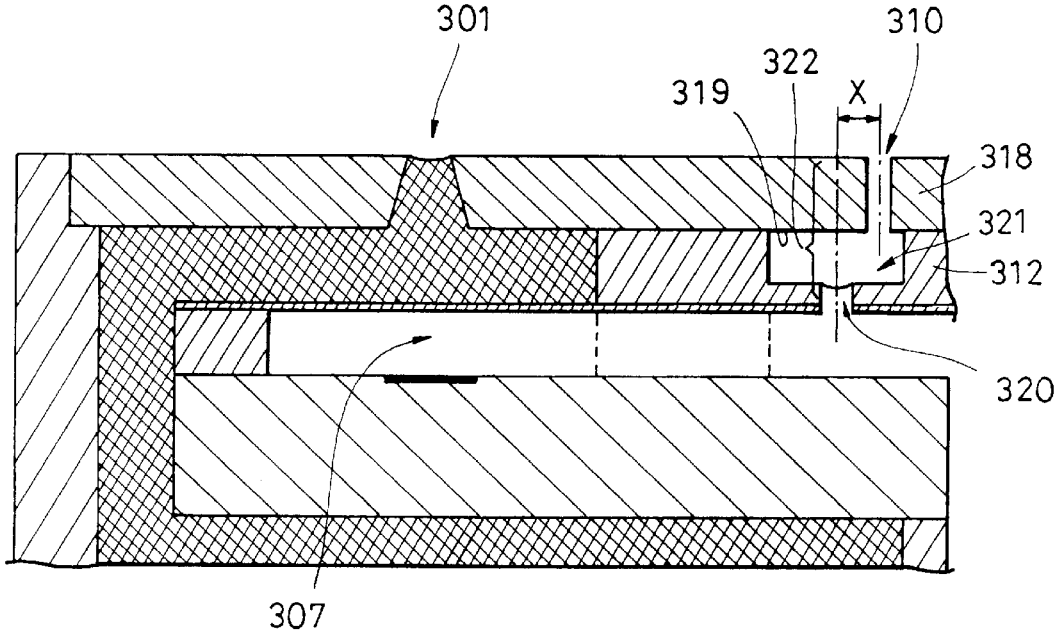
FIG. 6 is a sectional view of a liquid ejecting head of a fourth embodiment of the present invention taken along a direction of a liquid flow path.

Next, FIG. 6 shows a sectional view of a liquid ejecting head of a sixth embodiment taken along a direction of a liquid flow path.

The liquid ejecting head of a fourth embodiment is arranged such that the center line of an atmosphere communication port 310, which is formed through a top board 318, is shifted by a distance x from the center line of an atmosphere communication path introduction port 320, which is formed through a first flow path wall 312 and a movable separation membrane 305 so as to communicate with the atmosphere communication port 310 through an expanded section 321. The distance x is such that the projecting surface of the atmosphere communication port 310 and the atmosphere communication path introduction port 320 do not overlap each other. That is, in an atmosphere communication path 322 of the fourth embodiment, the atmosphere communication port 310 is shifted from the atmosphere communication path introduction port 320.

Since the other arrangement of the liquid ejecting head of the fourth embodiment is basically the same as that shown in the third embodiment, the detailed description thereof is omitted.

Since the center line of the atmosphere communication port 310 is shifted from that of the atmosphere communication path introduction port 320 by the distance x as described above, even if there is a bubble forming liquid, which is ejected from the atmosphere communication path introduction port 320 and cannot be captured by the expanded section 321, it is not directly ejected to the outside from the atmosphere communication port 310 because a droplet thereof collides with the back surface 319 of the top board 318, and thus the bubble forming liquid is eventually captured by the expanded section 321. Therefore, even if the atmosphere communication port 310 and the atmosphere communication path introduction port 320 are formed in the vicinity of a bubble generating region 307, there is not a possibility that the bubble forming liquid is ejected to the outside from the atmosphere communication port 310. Note that while the atmosphere communication port 310 is formed in a direction where it is apart from an ejection port 301, the fourth embodiment is not limited thereto and the atmosphere communication port 310 may be formed in a direction where it approaches the ejection port 301 by setting the distance x in the direction of the ejection port 301.

As described above, according to the liquid ejecting head of the fourth embodiment, remaining bubbles can be reliably removed by a simple structure similarly to the liquid ejecting heads of the first to third embodiments, and moreover a liquid ejecting efficiency can be improved as compared with a liquid ejecting head having a bubble forming liquid collection path.

Fifth Embodiment

Figure 7:
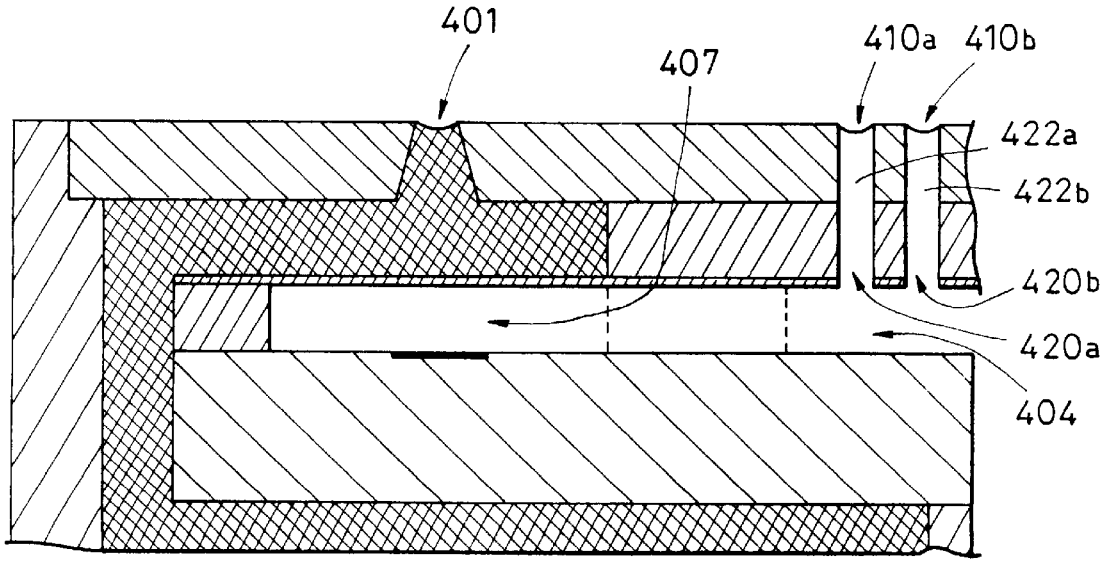
FIG. 7 is a sectional view of a liquid ejecting head of a fifth embodiment of the present invention taken along a direction of a liquid flow path.

Next, FIG. 7 shows a sectional view of a liquid ejecting head of a fifth embodiment taken along a direction of a liquid flow path.

The liquid ejecting head of the fifth embodiment additionally includes a second atmosphere communication path 442*b* in addition to a first atmosphere communication path 442*a* communicating with a second liquid flow path 404. Note that while the first and second atmosphere communication paths 442*a* 442*b* shown in FIG. 7 are disposed in a liquid flow path direction in parallel with each other, the present invention is not limited thereto and they may be formed in a depth direction in FIG. 7 (which is perpendicular to the direction of the liquid flow path and where the first and second atmosphere communication paths 442*a* and 442*b* overlap each other when drawn in FIG. 7). In the fifth embodiment, the first atmosphere communication port 410*a* of the first atmosphere communication path 442*a* and a first atmosphere communication path introduction port 420*a* have the same sectional area, and the second atmosphere communication port 410*b* of the second atmosphere communication path 442*b* and a second atmosphere communication path introduction port 420*b* also have the same sectional area. Note that the sectional area of the first atmosphere communication path 442*a* may be the same as or different from that of the second atmosphere communication port 410*b*, and two or more atmosphere communication paths may be formed.

Since the other arrangement of the liquid ejecting head of the fifth embodiment is basically the same as that shown in the first embodiment, the detailed description thereof is omitted.

As described above, in the liquid ejecting head of the fifth embodiment, a plurality of atmosphere communication ports, that is, the first atmosphere communication port 410*a* and the second atmosphere communication port 410*b* are formed. Accordingly, it is sufficient to secure a desired opening area for a bubble forming liquid from the total opening area of the respective atmosphere communication paths, and thus the respective opening areas of the first and second atmosphere communication ports 410*a* and 410*b* can be reduced. The bubble forming liquid is not ejected form the respective atmosphere communication ports because the desired opening area is secured by the total opening area of the respective atmosphere communication ports, and loss of bubble forming power can be reduced because the opening areas of the respective atmosphere communication ports are small. As a result, it is possible to from the first and second atmosphere communication ports 410*a* and 410*b* in the vicinity of a bubble generating region 407, which improves a remaining bubble removing efficiency.

As described above, according to the liquid ejecting head of the fifth embodiment, remaining bubbles can be reliably removed by a simple structure similarly to the liquid ejecting heads of the first to fourth embodiments, and moreover a liquid ejecting efficiency can be improved as compared with a liquid ejecting head having a bubble forming liquid collection path.

Sixth Embodiment

Figure 8:
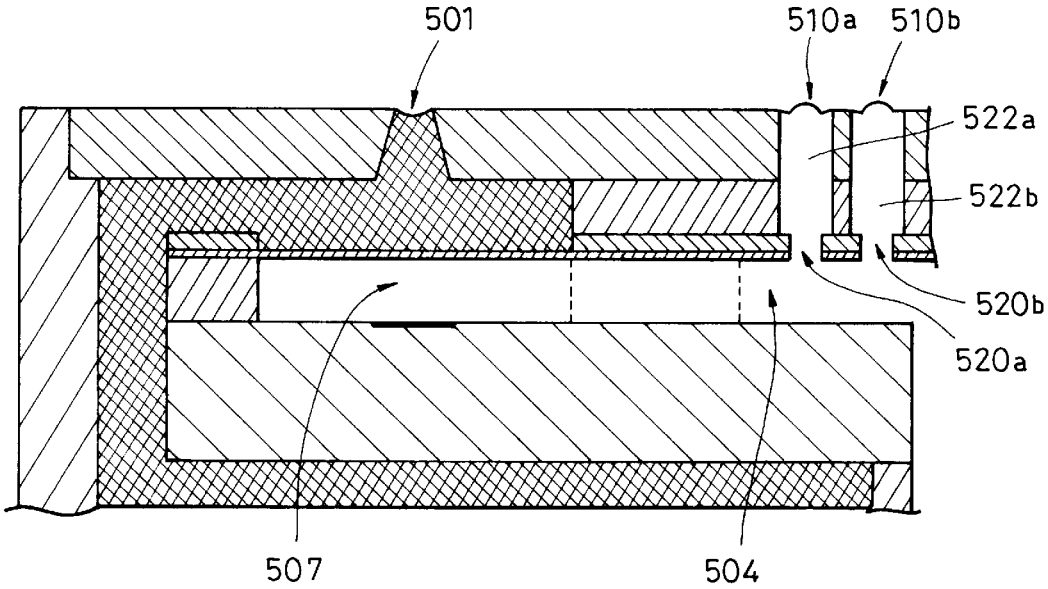
FIG. 8 is a sectional view of a liquid ejecting head of a sixth embodiment of the present invention taken along a direction of a liquid flow path.

Next, FIG. 8 shows a sectional view of a liquid ejecting head of a sixth embodiment taken along a direction of a liquid flow path.

The liquid ejecting head of the sixth embodiment includes a plurality of atmosphere communication paths, that is, a first atmosphere communication path 522*a* and a second atmosphere communication path 522*b*. Further, the first atmosphere communication path 522*a* communicates with the second atmosphere communication path 522*b* through a first atmosphere communication path introduction port 520*a* whose sectional area is smaller than the opening area of a first atmosphere communication port 510*a*, and a second atmosphere communication port 510*b* communicates with a second liquid flow path 504 through a second atmosphere communication path introduction port 520*b* whose sectional area is smaller than the opening area of the second atmosphere communication port 510*b* respectively.

Since the other arrangement of the liquid ejecting head of the sixth embodiment is basically the same as that shown in the fifth embodiment, the detailed description thereof is omitted.

As described above, since the sectional areas of the first and second atmosphere communication path introduction ports 520*a* and 520*b* are formed smaller than those of the first and second atmosphere communication ports 510*a* and 510*b*, it is difficult for ejection energy to be transmitted Up to the respective atmosphere communication ports passing through the respective atmosphere communication path introduction ports. Thus, loss of bubble forming power can be reduced. As a result, the opening areas of the respective atmosphere communication ports may be made larger than the opening area of an ejection port 501. In this case, it is more difficult for a bubble forming liquid to be ejected from the atmosphere communication ports 510 because ejection of the bubble forming liquid from the atmosphere communication ports 510 requires a larger amount of ejection energy than that required to eject a liquid from the ejecting port 501.

With the above arrangement, it is possible to from the first and second atmosphere communication path introduction ports 520*a* and 520*b* in the vicinity of a bubble generating region 507, which improves a remaining bubble removing efficiency.

As described above, according to the liquid ejecting head of the sixth embodiment, remaining bubbles can be reliably removed by a simple structure similarly to the liquid ejecting heads of the first to fifth embodiments, and moreover a liquid ejecting efficiency can be improved as compared with a liquid ejecting head having a bubble forming liquid collection path.

Seventh Embodiment

Figure 9:
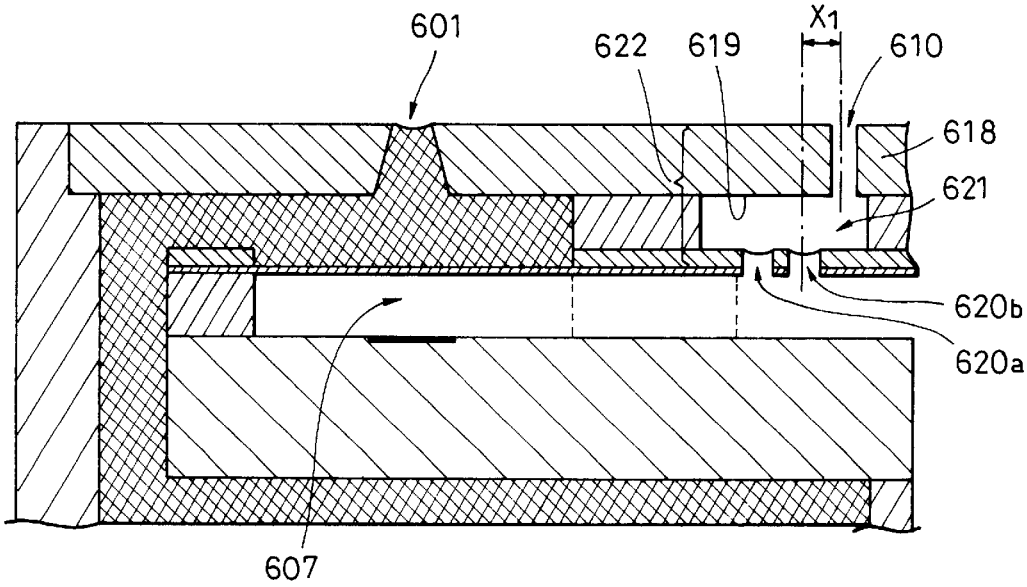
FIG. 9 is a sectional view of a liquid ejecting head of a seventh embodiment of the present invention taken along a direction of a liquid flow path.

Next, FIG. 9 shows a sectional view of a liquid ejecting head of a seventh embodiment taken along a direction of a liquid flow path.

The liquid ejecting head of the seventh embodiment includes a second atmosphere communication path introduction port 620*b,* in addition to an atmosphere communication port 610 and a first atmosphere communication path introduction port 620*a* communicating with the atmosphere communication port 610 through an expanded section 621. Further, the second atmosphere communication path introduction port 620*b,* which is located near to the atmosphere communication port 610, is formed at a position which is spaced apart from the atmosphere communication port 610 by a distance $x_1$ so that the projecting surface of the atmosphere communication port 610 and the second atmosphere communication path introduction port 620*b* do not overlap each other. That is, an atmosphere communication path 622 of the seventh embodiment is formed such that the two atmosphere communication path introduction ports communicate with the one atmosphere communication port through an expanded section, and, moreover, the atmosphere communication port 610 is shifted with respect to the respective atmosphere communication path introduction ports 620*a* and 620*b*.

Since the other arrangement of the liquid ejecting head of the seventh embodiment is basically the same as that shown in the fourth embodiment, the detailed description thereof is omitted.

Since the center line of the atmosphere communication path 610 is shifted from that of the second atmosphere communication path introduction port 620*b* by the distance $x_1$ as described above, even if there is a bubble forming liquid, which is ejected from the second atmosphere communication path introduction port 620*b* and cannot be captured by the expanded section 621, it is not directly ejected to the outside from the atmosphere communication path 610 because a droplet thereof collides with the back surface 619 of a top board 618. Thus, the bubble forming liquid is eventually captured by the expanded section 621. Therefore, even if the atmosphere communication path 610 and the respective atmosphere communication path introduction port 620*a* and 620*b* are formed in the vicinity of a bubble generating region 607, there is not a possibility that the bubble forming liquid is ejected to the outside from the atmosphere communication path 610. Further, since the plurality of atmosphere communication path introduction ports are formed, the sectional areas thereof can be reduced so that it is difficult for ejection energy to pass through the respective atmosphere communication path introduction ports. Thus, loss of bubble forming power can be reduced.

As described above, according to the liquid ejecting head of the seventh embodiment, remaining bubbles can be reliably removed by a simple structure similarly to the liquid ejecting heads of the first to sixth embodiments, and moreover a liquid ejecting efficiency can be improved as compared with a liquid ejecting head having a bubble forming liquid collection path.

Eighth Embodiment

Figure 10:
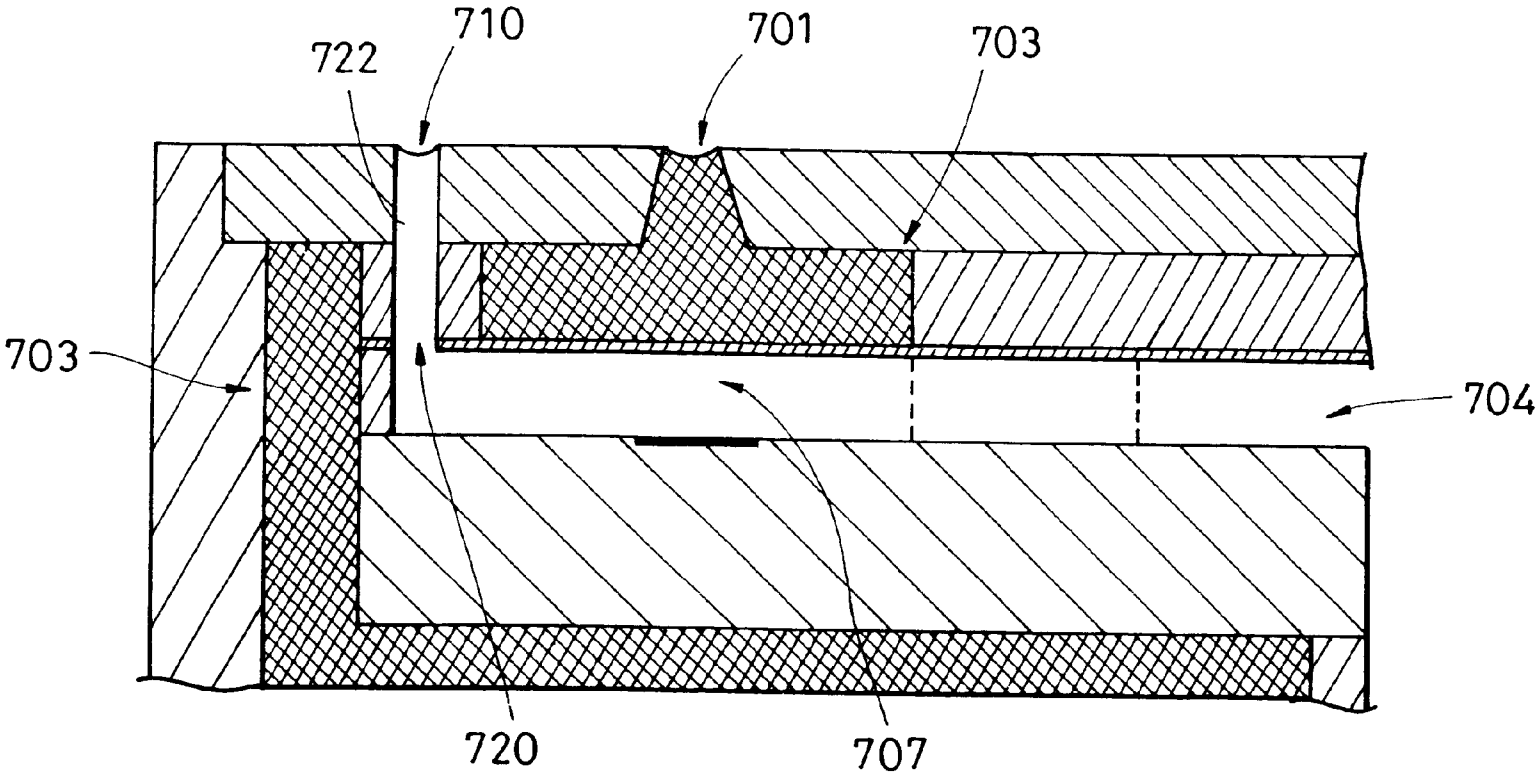
FIG. 10 is a sectional view of a liquid ejecting head of an eighth embodiment of the present invention taken along a direction of a liquid flow path.

Next, FIG. 10 shows a sectional view of a liquid ejecting head of an eighth embodiment taken along a direction of a liquid flow path.

When it is supposed that a bubble forming liquid is supplied from upstream of a second fluid path 704, an atmosphere communication path 722 of the liquid ejecting head of the eighth embodiment is formed downstream of a bubble generating region 707, in particular, at a most downstream portion in the eighth embodiment. That is, an atmosphere communication path introduction port 720 and an atmosphere communication port 710 also are formed downstream of the bubble generating region 707. As a result, a first liquid flow path 703 for supplying a liquid to be ejected communicates with a first liquid flow path 703, which directly communicates with an ejection port 701, so as to bypass the atmosphere communication path 722.

Since the other arrangement of the liquid ejecting head of the eighth embodiment is basically the same as that shown in the first embodiment, the detailed description thereof is omitted.

Since the atmosphere communication path 722 is formed downstream, a bubble forming liquid does not stagnate in the second fluid path 704, which improves a remaining bubble removing efficiency.

As described above, according to the liquid ejecting head of the eighth embodiment, the bubble forming liquid does not stagnate in the second fluid path 704, and moreover remaining bubbles can be reliably removed by a simple structure similarly to the liquid ejecting heads of the first to third embodiments as well as a liquid ejecting efficiency can be improved as compared with a liquid ejecting head having a bubble forming liquid collection path.

The liquid ejecting heads shown in the above-mentioned respective embodiments are not limited to the above arrangements and the respective arrangements of the embodiments may be appropriately combined with each other.

<Liquid ejecting head cartridge and liquid ejecting and recording apparatus>

Next, a liquid ejecting head cartridge on which a liquid ejecting head according to each of the above embodiments is mounted and a liquid ejecting and recording apparatus will be described with reference to FIGS. 11 and 12.

Figure 11:
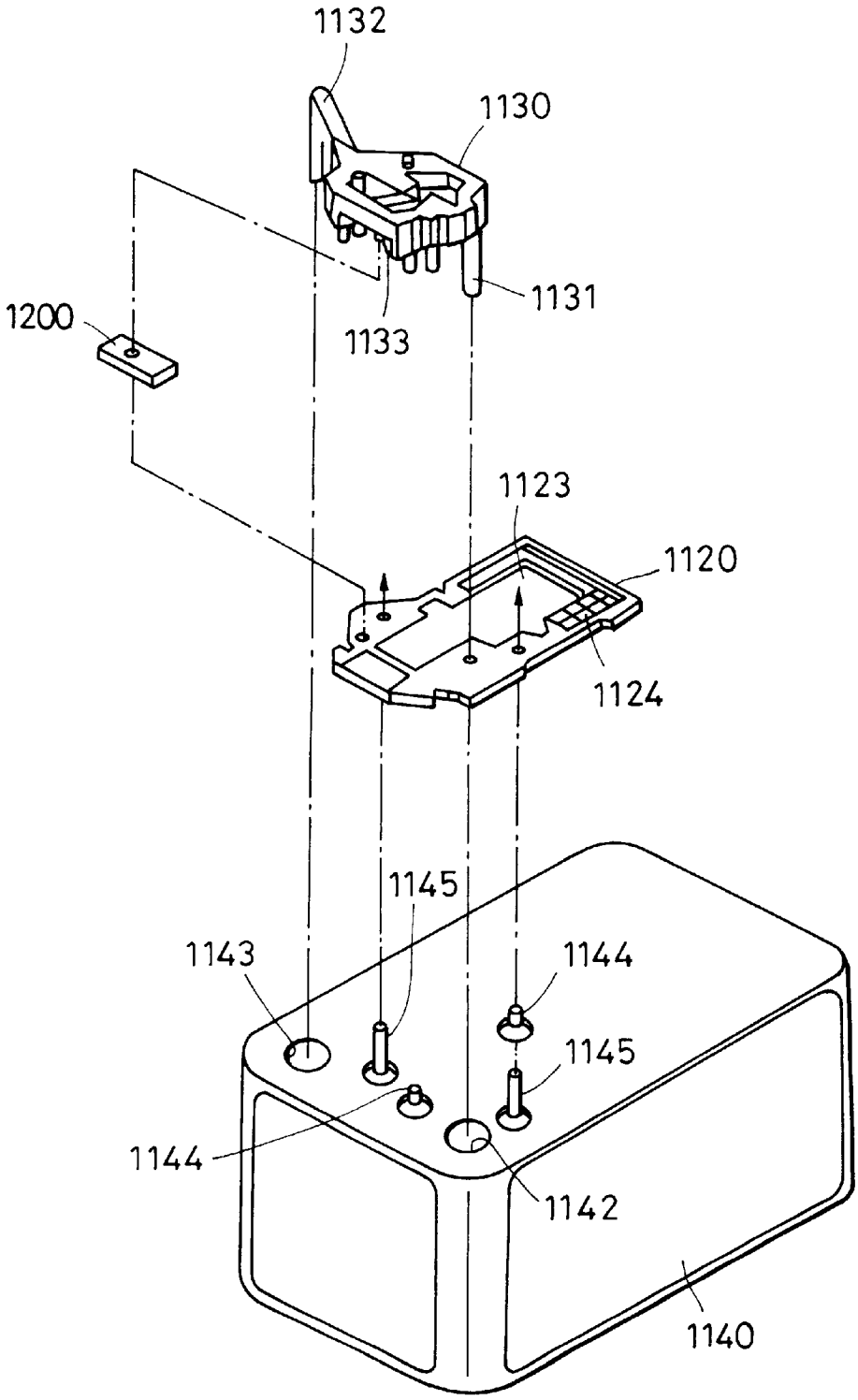
FIG. 11 is an exploded perspective view of a liquid ejecting head cartridge to which the present invention can be applied.

FIG. 11 is a schematic exploded perspective view of the liquid ejecting head cartridge including the above-mentioned liquid ejecting head, and the liquid ejecting head cartridge is mainly composed of a liquid ejecting head unit and a liquid vessel 1140.

The liquid ejecting head unit is composed of the above-mentioned liquid ejecting head 1200, a liquid supply member 1130, an aluminum base plate (support member) 1120 and the like. The support member 1120 is used to support the liquid ejecting head 1200 and the like, and a printed wire board 1123 and a contact pad 1124 are further disposed on the support member 1120. The printed wire board 1123 is connected to the liquid ejecting head 1200 to supply electric signals thereto, and the contact pad 1124 is in contact with an apparatus side to supply and receive electric signals thereto and therefrom.

The liquid vessel 1140 accommodates a liquid to be supplied to the liquid ejecting head 1200. Positioning members 1144 and fixed shafts 1145 are disposed on the outside of the liquid vessel 1140. The positioning members 1144 ar used to dispose a connecting member for connecting the liquid ejecting head unit to the liquid vessel 1140, and the fixed shafts 1145 are used to fix the connecting member. The liquid is supplied from the liquid supply paths 1142 and 1143 of the liquid vessel 1140 to the liquid supply paths 1131 and 1132 of the liquid supply member 1130 through the supply paths of the connecting member, and supplied to the common liquid chamber of the liquid ejecting head 1200 through the liquid supply paths 1133 of the respective members. While the liquid is supplied from the liquid vessel 1140 to the liquid supply member 1130 through the two separate paths, it is not necessarily supplied thereto through the separate paths.

Note that the liquid vessel 1140 may be refilled with a liquid after the previous liquid is consumed so that the liquid vessel 1140 can be reused. For this purpose, it is preferable to form a liquid injection port to the liquid vessel 1140. Further, the liquid ejecting head unit and the liquid vessel 1140 may be arranged integrally with each other or may be arranged so as to be separated from each other.

Figure 12:
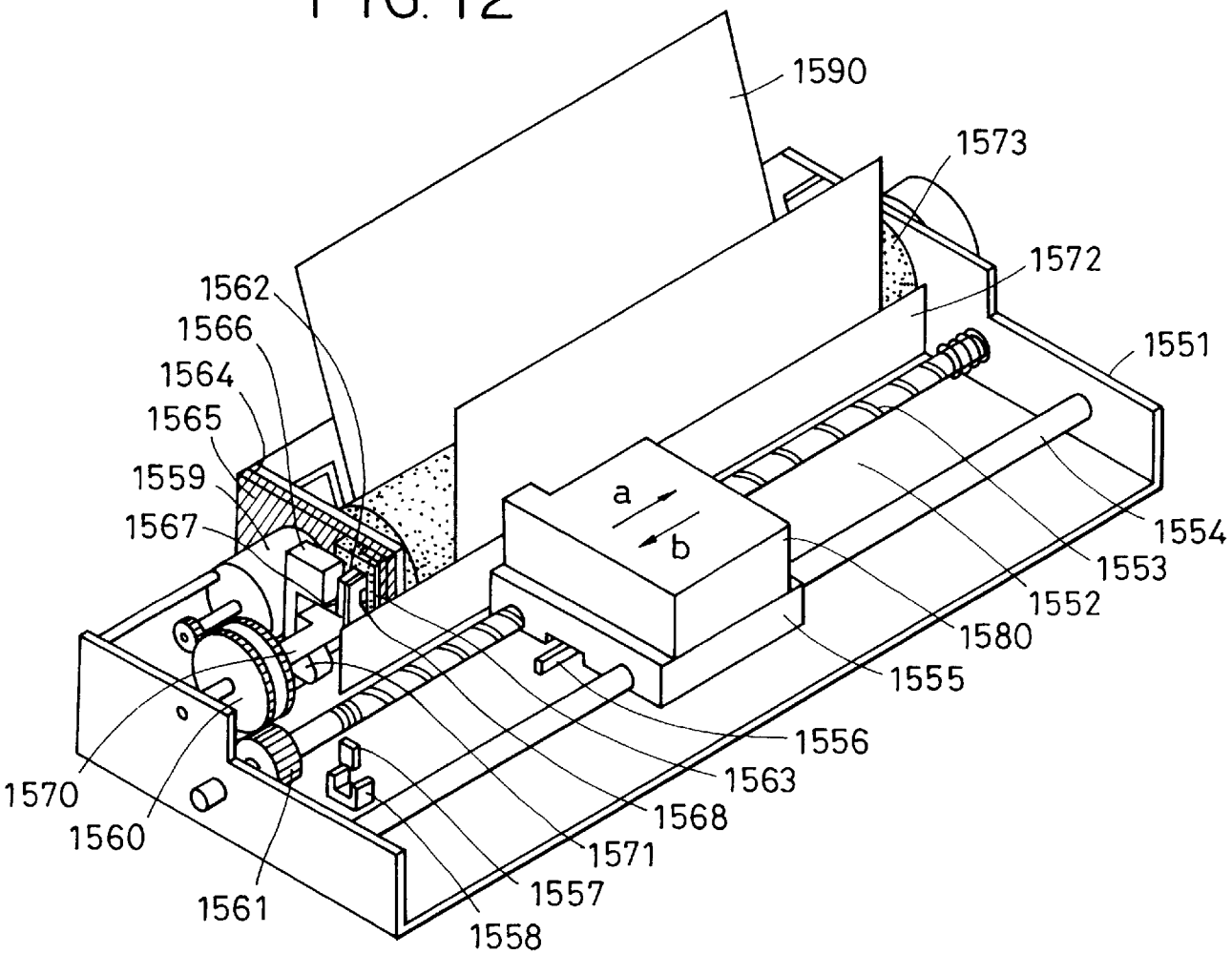
FIG. 12 is a schematic view showing an arrangement of a liquid ejecting apparatus to which the present invention can be applied.

FIG. 12 is a schematic perspective view of an embodiment of a liquid ejecting apparatus of the present invention on which the above-mentioned liquid ejecting head is mounted.

A lead screw 1552 having a spiral groove 1553 engraved therearound is rotatably supported by a main body frame 1551. The lead screw 1552 is rotated forward and backward by a drive motor 1559, which is driven forward and backward, through drive force transmission gears 1560 and 1561. Further, a guide rail 1554 is fixed to the main body frame 1551 to slidably guide a carriage 1555. The carriage 1555 includes a pin (not shown) engaged with the spiral groove 1553 so that the carriage 1555 can be reciprocated in the directions of arrows a and b shown in FIG. 12 by rotating the lead screw 1552 by the drive motor 1559. A sheet presser plate 1572 presses a recording medium 1590 against a platen roller 1573 throughout the moving range of the carriage 1555.

An inkjet recording head cartridge 1580 is mounted on the carriage 1555. The inkjet recording head cartridge 1580 is composed of the above-mentioned liquid ejecting head arranged integrally with an ink tank. Further, the inkjet recording head cartridge 1580 is fixed to and supported by the carriage 1555 through a positioning means and an electric contact which are disposed on the carriage 1555 so as to be detachable from the carriage 1555.

Photo-couplers 1557 and 1558 constitute a home position detecting means which carries out such operations as reversing of the rotating direction of the drive motor 1559, and the like by confirming the existence of the lever 1556 of the carriage 1555 in the region of the photo-couplers 1557 and 1558. A cap member 1567 for capping the front surface (surface where an ejecting port is formed) of the liquid ejecting head is supported by a support member 1562 and further includes a drawing means 1566 having a drawing unit. Then, the cap member 1567 restores the drawing capability of the liquid ejecting head through an opening 1568 inside the cap as well as forcibly draws remaining bubbles. The operation for restoring the drawing capability of the liquid ejecting head and the operation for forcibly drawing the remaining bubbles can be carried out simultaneously or individually. A support plate 1565 is mounted on a main body support plate 1564, and a cleaning plate 1563 slidably mounted on the support plate 1565 is moved forward and backward by a drive means (not shown). An arrangement of the cleaning blade 1563 is not limited to the one shown in FIG. 12, and it is needless to say that any known cleaning blade may be applied. A lever 1570 is used to start the draw and restoration operation of the liquid ejecting head. The lever 1570 is moved by the movement of a cam 1571 abutted against the carriage 1555, and the movement thereof is controlled by the drive force from the drive motor 1559 which is transmitted thereto through a known transmission means such as a gear and a latch to be changed.

The respective processing steps of capping, cleaning, and draw and restoration are carried out by the action of the lead screw 1552 when the carriage 1555 moves to a region on a home position side at the positions which correspond to the respective processing steps. Any desired processing operation can be applied to the embodiment so long as it is carried out at a known timing. Excellent records of images could be obtained by ejecting a liquid to various types of recording mediums by the liquid ejecting apparatus.

(Preferable technical view point of movable separation membrane)

The present invention has found conditions which are more preferable to the above movable separation membrane based on that the movable separation membrane of polyparaxylene (hereinafter, abbreviated as PPX) used in the above embodiments can be applied to other liquid ejecting heads having a movable separation membrane other than that of the present invention.

In particular, when the physical properties of PPX were examined, the following novel knowledge in practical use was obtained (in particular, a decomposing temperature of an organic membrane).

It should be noted that when a protective film for protecting a heating element and a cavitation resuatant form are formed on the surface of an element substrate, a term "on a surface layer of a heating element" used in the following description means on the surface of the film of the uppermost layer of these films of the surface of the element substrate, whereas when the protective film and the like are not formed, the term means on the surface of the heating element. That is, the term is used to show the portion where a bubble is formed by the heat generated by the heating element on the element substrate.

<Relationship between movable separation membrane and surface layer temperature of heating device>

In ordinary dye ink, film boiling for forming a bubble is generally caused when a bubble formation start temperature is rapidly increased (for example, 300° C. or more and about 350° C. in practical use on the surface layer of a heating element), and a maximum temperature when the bubble is formed may reach about 600° C. on the surface layer of the heating element. The temperature is generated for several seconds and does not continue for a long time. Then, when the bubble breaks, the temperature on the surface layer of the heating element is lowered to about 180° C. (about 200° C. in practical use).

When a movable separation membrane was used under the above conditions, the characteristics of a portion of the movable separation membrane were suddenly deteriorated rapidly or a portion thereof was suddenly broken in some cases. Then, preferable conditions required to the movable separation membrane could be found in a process for examining a cause of the above phenomena.

That is, when the movable separation membrane is formed by depositing an organic material by a method of chemical vapor reaction or plasma polymerization reaction, it is sufficient that the thermal decomposition temperature in these reaction processes is higher than a condition temperature to which the movable separation membrane is exposed. Further, even if the temperature of the movable separation membrane is temporarily made higher than the melting point thereof (which is lower than the thermal decomposition temperature thereof) in a short time of several tens of microseconds to several minutes, it is not necessary to take this matter into consideration.

There are following cases in a relationship between the movable separation membrane and the effect of the temperature on the surface layer of the heating element on the movable separation membrane when a liquid is ejected. Conditions effective in these cases will be exemplified below.

(1) When ejection is performed once

First, a case in which one droplet of a liquid is ejected from an initial state (or a continuously ejecting operation in which a long time passes until a next ejecting operation is started (for example, several tens of milliseconds to several seconds or more)) will be examined.

At this time, the movable separation membrane is ordinarily fixed by a second flow path wall from a time at which a bubble starts to be formed to a time at which the bubble grows and separated from the surface layer of a heating element by a predetermined distance through a liquid (bubble forming liquid). Thus, it is not necessary to take the direct effect of the temperature of the surface layer of the heating element on the movable separation membrane into consideration.

However, when the liquid is ejected from an ejecting port and the bubble breaks, it is supposed that the movable separation membrane approaches the surface layer of the movable separation membrane or comes into contact therewith. In this case, the movable separation membrane tends to return to the position of the initial state at once because a bubble forming liquid is refilled. Thus, it is sufficient to take the instant resistance against heat of the movable separation membrane into consideration.

Therefore, when the thermal decomposition temperature of a material used for the movable separation membrane is higher than the surface layer temperature of the heating element at the time the bubble breaks, even if the movable separation membrane comes into contact with the surface layer of the heating element, the movable separation membrane is not decomposed.

(2) When liquid is continuously ejected

Next, a case in which a liquid is continuously ejected at intervals of several tens to several hundreds of microseconds will be examined.

When the intervals of the ejecting operation are shortened as described above, if a bubble forming liquid is refilled so that a desired amount of it exists in a bubble generating region when it is necessary, a possibility that the movable separation membrane comes into contact with the surface layer of the heating element at a time a bubble starts to form must be taken into consideration rather than a possibility that the movable separation membrane comes into contact therewith at a time the bubble breaks.

In this case, when fine bubbles are generated by heating the heating element, the fine bubbles exist between the movable separation membrane and the surface layer of the heating element. Thus, the surface layer of the heating element is not made nearer to the movable separation membrane than the time at which the bubble started to form so long as the bubble continuously grows.

Accordingly, it is sufficient to take only the surface layer temperature of the heating element when the bubble starts to be form into consideration. Moreover, since the period of time during which the movable separation membrane comes into contact with the surface layer of the heating element is very short as described above, even if the movable separation membrane comes into contact with the surface layer of the heating element, the movable separation membrane is not decomposed similarly to time at which the bubble breaks so long as the thermally decomposing temperature of the material used for the movable separation membrane is made higher than the surface layer temperature of the heating element when the bubble starts to be formed.

Further, when the continuously ejecting operation is carried out for a long period of time of, for example, several to several tens of minutes, there is a case in which not only the maximum surface layer temperature of the heating element when a bubble starts to be formed but also the maximum surface layer temperature thereof when the bubble is being formed must be taken into consideration. In this case, it is preferable to consider it important that the movable separation membrane is not thermally decomposed even if a liquid ejecting head does not sufficiently radiate its heat because the ejecting operation is performed continuously.

That is, since the temperature of the liquid ejecting head does not exceed the above-mentioned maximum surface layer temperature of the heating element when the bubble being formed, there is not a possibility that the movable separation membrane is thermally decomposed so long as the thermally decomposing temperature of the material used for the movable separation membrane is higher than the maximum surface layer temperature of the heating element.

(3) When abnormal operation is performed

Next, a case will be examined in which an abnormal operation is caused due to an insufficient bubble forming liquid (or no bubble forming liquid) in the bubble generating region of a second liquid flow path because, for example, it is not refilled sufficiently.

In this case, there is an increasing possibility that a portion of the movable separation membrane corresponding to a pertinent nozzle is abutted against a heating element as well as no liquid is ejected from a corresponding ejecting port.

An ordinary liquid ejecting head or a liquid ejecting and recording apparatus on which the liquid ejecting head is mounted includes a detection unit for detecting a state in which no liquid is ejected and can restore the state to an ordinary ejection state by restoring a bubble forming liquid flow path (and a liquid to be ejected flow path when necessary) by a restoring means such as a known draw and restoration unit or the like.

When the restoring means is provided, conditions required to the film is different depending on a time necessary to restore the abnormal operation after it occurs and on an amount of the bubble forming liquid existing in the bubble generating region.

When the restoring operation is performed in, for example, about several tens of seconds to several minutes after the abnormal operation occurs, it is not necessary to take the melting point of the movable separation membrane into consideration and it is only necessary to take the thermally decomposing temperature thereof.

Further, when the movable separation membrane is left as it is in a state that it is abutted against the surface layer of the heating element without refilling the bubble forming liquid at a time a bubble breaks or when the bubble forming liquid is insufficiently refilled in the above-mentioned continuously ejecting operation and a state that the movable separation membrane often comes into contact with the heating element continues a long period of time of several tens of minutes or more at a time a bubble breaks, it is preferable to consider it important that the melting point of the movable separation membrane is higher than the surface layer temperature of the heating element at a time a bubble breaks.

In contrast, when a state that almost no bubble forming liquid exits in the bubble generating region continues for a long period of time of several tens of minutes or more, it is preferable to consider it important that the melting point of the movable separation membrane is higher than the surface layer temperature of the heating element at a time a bubble starts to be formed.

<Example of PPX>

The inventors paid attention to PPX as a material satisfying a relationship between the above-mentioned movable separation membrane and the surface layer temperature of the heating element.

The basic structure, manufacturing method, polymerization method and the like of PPX in the present invention are disclosed in the Publications described in the above-mentioned embodiments. PPX is specifically defined in the chemical formulas (A) to (F) shown in FIG. 13 (n: integer of at least 5000) and they may be used singly or in combination.

Further, these PPXs have the following common features.

The PPXs are a crystalline polymer of high purity, which does not contain ionic impurities and has a degree of crystallization of about 60% and a molecular weight of about 500,000, and excellent in repellency and a gas barrier property. Further, they are insoluble to all the organic solvents having a temperature of 150° C. or less and resistant to almost all the acid and alkaline corrosive liquids. Further, they exhibit excellent stability to repeated displacement. Furthermore, when they are formed to a film, the thickness of the film can be precisely controlled easily, and the film can be formed to a shape which can be closely fitted to the shape of a material to be deposited thereon as well as they can be formed to a film without a pinhole even if the thickness of the film is 0.2 im depending upon a type of a material to be deposited thereon. Further, they are excellent in adhesive stability to a material to be deposited thereon after it is formed to a film because mechanical stress due to effect stress and thermal stress due to thermal strain are not applied to the material to be deposited.

Figure 13A:
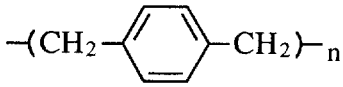
FIG. 13A to FIG. 13F show chemical formulas of basic forms of polyparaxylene (PPX) of the present invention (n: integer or 5000 or more)
Figure 13B:
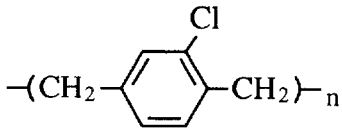
Figure 13C:
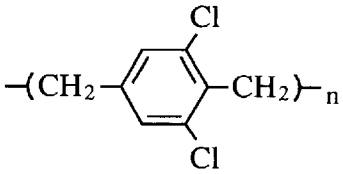
Figure 13D:
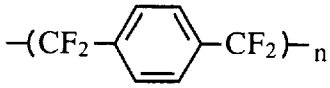
Figure 13E:
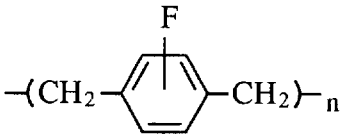
Figure 13F:
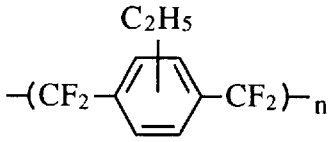

Thus, head base members, which were formed integrally with movable separation membranes, were made using the materials shown in FIGS. 13A to 13C by the above-mentioned manufacturing method (however, the movable separation membranes themselves were formed by a vapor polymerization method, and, as to a material for sacrificing layers, an appropriate material (for example, Al or the like) was selected which could obtain a selection ratio between the movable separation membranes and element substrates by a solvent of an etching rate). Then, liquid ejecting heads were made by jointing the head base members to top boards using an adhesive or the like.

The physical properties and the basic characteristics of the respective materials and the properties thereof when they were formed to films were examined. Table 1 shows a result of the examination.

TABLE 1

| Specimen | A Composition shown in FIG. 13A | B Composition shown in FIG. 13B | C Composition shown in FIG. 13C |
|---|---|---|---|
| Melting Point | 405° C. | 280° C. | 850° C. |
| Properties | Clear and colorless<br>Excellent in penetration to small gaps<br>Soft coated film<br>Excellent in electric characteristics<br>Exhibit given dielectric characteristics in respective frequency regions<br>High insulation strength | Clear and colorless<br>Excellent in prevention of penetration of vapor and gas<br>Formation of thin film without pinhole<br>Excellent in electric characteristics | Clear and colorless<br>Slightly hard coated film<br>Excellent in chemical resistance<br>Excellent in heat resistance |
| Vapor deposition | A little slow | Good | No so good |

These specimens have a thermally decomposing temperature of 680° C. as an example and any of the specimens has the thermally decomposing temperature of about 700° C., and the thermally decomposing temperature is higher than any of the surface layer temperature of a heating element when a bubble breaks and the maximum surface layer temperature reached by the heating element.

Further, the melting point of any of the specimens is higher than the surface layer temperature of the heating element when a bubble breaks. Note that, in the comparison between the melting points of the respective specimens and the surface layer temperature of the heating element when film boiling is started by the heating element, the melting points of the specimens A and C are higher than the surface layer temperature of the heating element when the film boiling is started.

It can be confirmed that any of the liquid ejecting heads, which employ the above-mentioned specimens as a movable separation membrane, not only greatly increases the number of ejection of a droplet in respective nozzles and has improved head durability but also instantly restores an abnormal state to a normal state by performing restore processing when it is detected that no liquid is ejected as compared with conventional known liquid ejecting heads using conventionally known other organic materials such as polyimide and the like as the movable separation membrane. Further, the specimens were not corroded by ink.

It should be noted that the excellent radiating property of the head, which is obtained by that both the head base member and the top board are composed of a silicon material, contributes to achieve a more excellent life extending effect of the head also when the above-mentioned movable separation membrane is used.

How a PPX film is subjected to vapor deposition in the above-mentioned manufacturing process will be supplementarily described here with reference to FIG. 14.

Figure 14A:
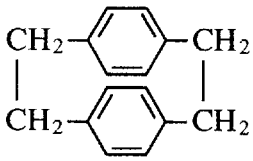
FIG. 14A to FIG. 14C are views explaining a change a material shown in FIG. 13A in a reaction process when a movable separation membrane is made only by polyparaxylene.
Figure 14B:
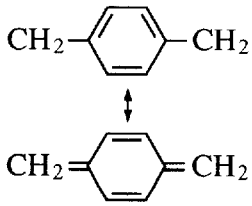
Figure 14C:
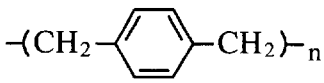

FIG. 14A to FIG. 14C are views explaining how a PPX (specimen A) shown in FIG. 13A is varied in a vapor deposition reaction process when a movable separation membrane is made only by the specimen. First, diparaxylene as a solid dimer shown in FIG. 14A which is used as a material is vaporized at a temperature of 100° C. to 200° C. Next, a stable radical paraxylene monomer as shown in FIG. 14B is created by thermally decomposing the dimer at a temperature of about 700° C. described above. Then, the diradical paraxylene is simultaneously absorbed to and polymerized with components such as a liquid ejecting head base member, a Si wafer and the like a movable separation membrane is formed of polyparaxylene at a room temperature.

In particular, when the specimen is changed from the state shown in FIG. 14B to the state shown in FIG. 14C so as to form the movable separation membrane, the specimen is processed in a degree of vacuum of 13.3 Pa or less. As a result, the invasion of the diradical paraxylene, which is created by thermally decomposing the dimer made in a gaseous phase state, into minute portions of the movable separation membrane is accelerated and the intimate contact property of thereof with fixed components (pedestal, liquid flow path and the like) can be improved by forming chemically stable bonds of the movable separation membrane to the fixed components.

<Supplemental technical problems and effects>

The present invention, in which the above-mentioned organic membrane as well as a heating element is used and a liquid is ejected by means of a bubble formed by film boiling, takes situations which may be caused when it is practically used, and thus the present invention exceeds a conventional technical level and is an effective invention.

It should be noted that while some of the technologies of the conventional levels recognize an improvement in an ejection efficiency as a problem to be solved, many of them aim at a movable separation membrane capable of simply separating a bubble forming liquid from a liquid to be ejected.

When this point of view is taken into consideration, the problem recognized by the present invention resides in "an improvement of durability of the movable separation membrane as a single body and the liquid ejecting head when thermal factors are taken into consideration in the displacement of the movable separation membrane which is caused in a series of change of a bubble from generation—growth—breakage". Accordingly, the present invention is novel in the above meaning.

Accordingly, the embodiments of the present invention having solved the above problems eliminate factors by which the problem is caused and can restore an abnormal operation to a normal operation at once by restoration processing even if the abnormal operation occurs. As a result, the present invention has such an effect that the liquid ejecting head can be used for a much longer period of time without breaking the movable separation membrane and the life of the liquid ejecting head itself can be increased as compared with a liquid ejecting head having a conventional movable separation membrane and that a liquid ejecting head having a plurality of nozzles can be prevented from being partially damaged. The respective embodiments of the present invention are effective even if they are singly employed as well as a combination thereof can exhibit a more excellent effect.

As described above, according to the present invention, remaining bubbles can be removed by the atmosphere communication path for communicating the second liquid flow path with the atmosphere without using a collection path for removing the remaining bubbles and a mechanism for circulating a bubble forming liquid. As a result, not only the structure of the liquid ejecting head is simplified but also an ejection efficiency can be improved as compared with a liquid ejecting head including a collection path. Further, remaining bubbles in the atmosphere communication path can also drawn using the drawing means for restoring the ejecting capability of an ejecting port because the atmosphere communication path and the ejecting port are formed through the same surface. Accordingly, the remaining bubbles can be reliably removed without making the structure of the liquid ejecting apparatus complex.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid ejecting head including a first liquid flow path communicating with an ejecting port for ejecting a liquid to be ejected and an element substrate having a heating element for forming a bubble from a bubble forming liquid as well as including a second liquid flow path corresponding to said first liquid flow path and a movable separation membrane for substantially separating said first liquid flow path and said second liquid flow path corresponding to said first liquid flow path from each other at all times, comprising:

an atmosphere communication port facing the atmosphere for communicating said second liquid flow path with the atmosphere; and an atmosphere communication path having an atmosphere communication path introduction port facing said second liquid flow path, wherein said atmosphere communication port is formed through the same surface as that of said ejecting port, and wherein when said ejecting port has an area $S_0$, said atmosphere communication port has an area $S_1$ and said atmosphere communication path introduction port has an area $S_2$, relationships of $S_0<S_1$ and $S_2<S_1$ are established.

2. A liquid ejecting head according to claim 1, wherein when a supply source of the bubble forming liquid is located upstream, said atmosphere communication path introduction port is formed downstream of said heating element.

3. A liquid ejecting head according to claim 1, wherein a plurality of said atmosphere communication paths are formed.

4. A head cartridge, comprising a liquid ejecting head according to claim 1, and an ink tank for holding a liquid to be ejected by said liquid ejecting head.

5. A liquid ejecting apparatus, comprising a liquid ejecting head according to claim 1, an ink tank for holding a liquid to be ejected by said liquid ejecting head, a mounting section on which said liquid ejecting head is mounted, and a drawing means for drawing a liquid to be ejected from said ejecting port of said liquid ejecting head as well as for drawing a bubble forming liquid and remaining bubbles from said atmosphere communication path.

6. A liquid ejecting apparatus, comprising a liquid ejecting head according to claim 1, an ink tank for holding a liquid to be ejected by said liquid ejecting head, a mounting section on which said liquid ejecting head is mounted, and a drawing means for drawing a liquid to be ejected from said ejecting port of said liquid ejecting head as well as for drawing a bubble forming liquid and remaining bubbles from said atmosphere communication path, wherein said drawing means draws the liquid to be ejected as well as the bubble forming liquid and the remaining bubbles simultaneously.

7. A liquid ejecting head according to claim 1, wherein a projecting surface of said atmosphere communication port and said atmosphere communication path introduction port of said atmosphere communication path do not overlap each other.

8. A liquid ejecting head according to claim 1, wherein a plurality of said atmosphere communication path introduction ports are formed.

9. A liquid ejecting head according to claim 1, wherein an expanded section, which has a sectional area sufficient to prevent bubble forming liquid from rising up to said atmosphere communication port from said atmosphere communication path introduction port by capillary force, is formed midway of said atmosphere communication path.

10. A liquid ejecting head according to claim 1, wherein said movable separation membrane is an organic film formed by a deposition method by chemical vapor reaction or plasma polymerization reaction.

11. A liquid ejecting head according to claim 1, wherein said movable separation membrane contains polyparaxylene.

12. A liquid ejecting head including a first liquid flow path communicating with an ejecting port for ejecting a liquid to be ejected and an element substrate having a heating element for forming a bubble from a bubble forming liquid as well as including a second liquid flow path corresponding to said first liquid flow path and a movable separation membrane for substantially separating said first liquid flow path and said second liquid flow path corresponding to said first liquid flow path from each other at all times, comprising:

an atmosphere communication port facing the atmosphere for communicating said second liquid flow path with the atmosphere; and an atmosphere communication path having an atmosphere communication path introduction port facing said second liquid flow path, wherein said atmosphere communication port is formed through the same surface as that of said ejecting port, and wherein an expanded section, which has a sectional area sufficient to prevent bubble forming liquid from rising up to said atmosphere communication port from said atmosphere communication path introduction port by capillary force, is formed midway of said atmosphere communication path.

13. A liquid ejecting head according to claim 12, wherein when said ejecting port has an area $S_0$ and said atmosphere communication port has an area $S_1$, a relationship of $S_1<S_0$ is established.

14. A liquid ejecting head according to claim 12, wherein a projecting surface of said atmosphere communication port and said atmosphere communication path introduction port of said atmosphere communication path do not overlap each other.

15. A liquid ejecting head according to claim 12, wherein a plurality of said atmosphere communication path introduction ports are formed.

16. A liquid ejecting head according to claim 12, wherein when a supply source of the bubble forming liquid is located upstream, said atmosphere communication path introduction port is formed downstream of said heating element.

17. A liquid ejecting head according to claim 12, wherein a plurality of said atmosphere communication paths are formed.

18. A head cartridge, comprising a liquid ejecting head according to claim 12, and an ink tank for holding a liquid to be ejected by said liquid ejecting head.

19. A liquid ejecting apparatus, comprising a liquid ejecting head according to claim 12, an ink tank for holding a liquid to be ejected by said liquid ejecting head, a mounting section on which said liquid ejecting head is mounted, and a drawing means for drawing a liquid to be ejected from said ejecting port of said liquid ejecting head as well as for drawing a bubble forming liquid and remaining bubbles from said atmosphere communication path.

20. A liquid ejecting apparatus, comprising a liquid ejecting head according to claim 12, an ink tank for holding a liquid to be ejected by said liquid ejecting head, a mounting section on which said liquid ejecting head is mounted, and a drawing means for drawing a liquid to be ejected from said ejecting port of said liquid ejecting head as well as for drawing a bubble forming liquid and remaining bubbles from said atmosphere communication path, wherein said drawing means draws the liquid to be ejected as well as the bubble forming liquid and the remaining bubbles simultaneously.

21. A liquid ejecting head including a first liquid flow path communicating with an ejecting port for ejecting a liquid to be ejected and an element substrate having a heating element for forming a bubble from a bubble forming liquid as well as including a second liquid flow path corresponding to said first liquid flow path and a movable separation membrane for substantially separating said first liquid flow path and said second liquid flow path corresponding to said first liquid flow path from each other at all times, comprising:

an atmosphere communication port facing the atmosphere for communicating said second liquid flow path with the atmosphere; and an atmosphere communication path having an atmosphere communication path introduction port facing said second liquid flow path, wherein said atmosphere communication port is formed through the same surface as that of said ejecting port, wherein said movable separation membrane is an organic film formed by a deposition method by chemical vapor reaction or plasma polymerization reaction, and wherein said movable separation membrane contains polyparaxylene.

22. A liquid ejecting head according to claim 21, wherein when a supply source of the bubble forming liquid is located upstream, said atmosphere communication path introduction port is formed downstream of said heating element.

23. A liquid ejecting head according to claim 21, wherein a plurality of said atmosphere communication path introduction ports are formed.

24. A liquid ejecting head according to claim 21, wherein a plurality of said atmosphere communication paths are formed.

25. A head cartridge, comprising a liquid ejecting head according to claim 21, and an ink tank for holding a liquid to be ejected by said liquid ejecting head.

26. A liquid ejecting apparatus, comprising a liquid ejecting head according to claim 21, an ink tank for holding a liquid to be ejected by said liquid ejecting head, a mounting section on which said liquid ejecting head is mounted, and a drawing means for drawing a liquid to be ejected from said ejecting port of said liquid ejecting head as well as for drawing a bubble forming liquid and remaining bubbles from said atmosphere communication path.

27. A liquid ejecting apparatus, comprising a liquid ejecting head according to claim 21, an ink tank for holding a liquid to be ejected by said liquid ejecting head, a mounting section on which said liquid ejecting head is mounted, and a drawing means for drawing a liquid to be ejected from said ejecting port of said liquid ejecting head as well as for drawing a bubble forming liquid and remaining bubbles from said atmosphere communication path, wherein said drawing means draws the liquid to be ejected as well as the bubble forming liquid and the remaining bubbles simultaneously.

28. A liquid ejecting head including a first liquid flow path communicating with an ejecting port for ejecting a liquid to be ejected and an element substrate having a heating element for forming a bubble from a bubble forming liquid as well as including a second liquid flow path corresponding to said first liquid flow path and a movable separation membrane for substantially separating said first liquid flow path and said second liquid flow path corresponding to said first liquid flow path from each other at all times, comprising:

an atmosphere communication port facing the atmosphere for communicating said second liquid flow path with the atmosphere; and an atmosphere communication path having an atmosphere communication path introduction port facing said second liquid flow path, wherein said atmosphere communication port is formed through the same surface as that of said ejecting port, wherein said movable separation membrane is an organic film formed by a deposition method by chemical vapor reaction or plasma polymerization reaction, and wherein when said ejecting port has an area $S_0$ and said atmosphere communication port has an area $S_1$, a relationship of $S_1<S_0$ is established.

29. A liquid ejecting head including a first liquid flow path communicating with an ejecting port for ejecting a liquid to be ejected and an element substrate having a heating element for forming a bubble from a bubble forming liquid as well as including a second liquid flow path corresponding to said first liquid flow path and a movable separation membrane for substantially separating said first liquid flow path and said second liquid flow path corresponding to said first liquid flow path from each other at all times, comprising:

an atmosphere communication port facing the atmosphere for communicating said second liquid flow path with the atmosphere; and an atmosphere communication path having an atmosphere communication path introduction port facing said second liquid flow path, wherein said atmosphere communication port is formed through the same surface as that of said ejecting port, wherein said movable separation membrane is an organic film formed by a deposition method by chemical vapor reaction or plasma polymerization reaction, and wherein a projecting surface of said atmosphere communication port and said atmosphere communication path introduction port of said atmosphere communication path do not overlap each other.

30. A liquid ejecting head including a first liquid flow path communicating with an ejecting port for ejecting a liquid to be ejected and an element substrate having a heating element for forming a bubble from a bubble forming liquid as well as including a second liquid flow path corresponding to said first liquid flow path and a movable separation membrane for substantially separating said first liquid flow path and said second liquid flow path corresponding to said first liquid flow path from each other at all times, comprising;

an atmosphere communication port facing the atmosphere for communicating said second liquid flow path with the atmosphere; and an atmosphere communication path having an atmosphere communication path introduction port facing said second liquid flow path, wherein said atmosphere communication port is formed through the same surface as that of said ejecting port, wherein said movable separation membrane is an organic film formed by a deposition method by chemical vapor reaction or plasma polymerization reaction, and wherein an expanded section, which has a sectional area sufficient to prevent bubble forming liquid from rising up to said atmosphere communication port from said atmosphere communication path introduction port by capillary force, is formed midway of said atmosphere communication path.

* * * * *

UNITED STATES PATENT AND TRADEMARK OFFICE

CERTIFICATE OF CORRECTION

PATENT NO. : 6,517,198 B2
DATED : February 11, 2003
INVENTOR(S) : Aya Yoshihira et al.

It is certified that error appears in the above-identified patent and that said Letters Patent is hereby corrected as shown below:

Column 8,
Line 25, “jointed by a” should read -- joined by --.

Column 9,
Line 18, “to be remained” should read -- to remain --.

Column 10,
Line 15, “prefrably” should read -- preferably --;
Line 39, “paths” should read -- path --.

Column 12,
Line 67, “The” should read -- the --.

Column 16,
Line 67, “Up” should read -- up --.

Column 19,
Line 15, “ar” should read -- are --.

Column 20,
Line 47, “resuatant” should read -- resultant --.

Column 22,
Line 38, “being” should read -- is being --;
Line 58, “ejected” should read -- ejected from a --.

Column 23,
Line 50, “im” should read -- $\mu$m --.

UNITED STATES PATENT AND TRADEMARK OFFICE

CERTIFICATE OF CORRECTION

PATENT NO. : 6,517,198 B2
DATED : February 11, 2003
INVENTOR(S) : Aya Yoshihira et al.

It is certified that error appears in the above-identified patent and that said Letters Patent is hereby corrected as shown below:

Column 24,
Line 47, "increases" should read -- increase --;
Line 48, "ejection" should read -- ejections --.

Signed and Sealed this

Twenty-first Day of October, 2003

JAMES E. ROGAN
*Director of the United States Patent and Trademark Office*